US007876054B2

(12) United States Patent
Kim et al.

(10) Patent No.: US 7,876,054 B2
(45) Date of Patent: Jan. 25, 2011

(54) PLASMA DISPLAY APPARATUS

(75) Inventors: Byunghyun Kim, Gumi (KR); Yoonseok Kwak, Gumi (KR); Heekwon Kim, Gumi (KR); Jongjin Jeong, Gumi (KR)

(73) Assignee: LG Electronics Inc., Seoul (KR)

( * ) Notice: Subject to any disclaimer, the term of this patent is extended or adjusted under 35 U.S.C. 154(b) by 428 days.

(21) Appl. No.: 12/116,238

(22) Filed: May 7, 2008

(65) Prior Publication Data

US 2009/0134809 A1 May 28, 2009

(30) Foreign Application Priority Data

Nov. 27, 2007 (KR) ..... 10-2007-0121516

(51) Int. Cl.
*G09G 3/10* (2006.01)

(52) U.S. Cl. ..... 315/169.4; 315/161; 315/167; 345/63; 345/690

(58) Field of Classification Search ..... 315/160, 315/161, 167–168, 169.1–169.4; 345/60–68, 345/690–692; 313/582
See application file for complete search history.

(56) References Cited

U.S. PATENT DOCUMENTS

| | | | | |
|---|---|---|---|---|
| 7,138,966 | B2 * | 11/2006 | Shindo et al. | 345/63 |
| 7,212,177 | B2 * | 5/2007 | Kanazawa et al. | 345/63 |
| 7,612,740 | B2 * | 11/2009 | Kim et al. | 345/63 |
| 7,719,487 | B2 * | 5/2010 | Hashimoto et al. | 345/63 |
| 2005/0093470 | A1 * | 5/2005 | Choi | 315/169.4 |

* cited by examiner

*Primary Examiner*—Douglas W Owens
*Assistant Examiner*—Tung X Le
(74) *Attorney, Agent, or Firm*—Fish & Richardson P.C.

(57) ABSTRACT

A plasma display apparatus is disclosed. The plasma display apparatus includes a plasma display panel and a driver. The plasma display apparatus includes a scan electrode, a sustain electrode, an address electrode, a lower dielectric layer on the address electrode, and a phosphor layer on the lower dielectric layer. The phosphor layer includes a phosphor material and an additive material. The driver does not supply a sustain signal to at least one of the scan electrode and the sustain electrode during a sustain period of a first subfield of a plurality of subfields of a frame. A sustain period of at least one subfield of the plurality of subfields of the frame is omitted.

16 Claims, 23 Drawing Sheets

(a)

(b)

| | Comparative example | Experimental example 1 | Experimental example 2 | Experimental example 3 |
|---|---|---|---|---|
| Firing voltage | 135V | 128V | 129V | 127V |
| Luminance | 170(cd/$m^2$) | 176(cd/$m^2$) | 178(cd/$m^2$) | 177(cd/$m^2$) |
| Contrast ratio | 55:1 | 60:1 | 58:1 | 61:1 |

PLASMA DISPLAY APPARATUS

This application claims the benefit of Korean Patent Application No. 10-2007-0121516 filed on Nov. 27, 2008, which is hereby incorporated by reference.

BACKGROUND

1. Field

An exemplary embodiment relates to a plasma display apparatus.

2. Description of the Background Art

A plasma display apparatus includes a plasma display panel. The plasma display panel includes a phosphor layer inside discharge cells partitioned by barrier ribs and a plurality of electrodes.

When driving signals are applied to the electrodes of the plasma display panel, a discharge occurs inside the discharge cells. In other words, when the plasma display panel is discharged by applying the driving signals to the discharge cells, a discharge gas filled in the discharge cells generates vacuum ultraviolet rays, which thereby cause phosphors positioned between the barrier ribs to emit light, thus producing visible light. An image is displayed on the screen of the plasma display panel due to the visible light.

SUMMARY

In one aspect, a plasma display apparatus comprises a plasma display panel and a drive, wherein the plasma display panel includes a front substrate on which a scan electrode and a sustain electrode are positioned, a rear substrate on which an address electrode is positioned to intersect the scan electrode and the sustain electrode, a lower dielectric layer on the address electrode; and a phosphor layer on the lower dielectric layer, the phosphor layer including a phosphor material and an additive material, wherein the driver does not supply a sustain signal to at least one of the scan electrode and the sustain electrode during a sustain period of a first subfield of a plurality of subfields of a frame, wherein a sustain period of at least one subfield of the plurality of subfields of the frame is omitted.

In another aspect, a plasma display apparatus comprises a plasma display panel and a driver, wherein the plasma display panel includes a front substrate on which a scan electrode and a sustain electrode are positioned, a rear substrate on which an address electrode is positioned to intersect the scan electrode and the sustain electrode, a lower dielectric layer on the address electrode, and a phosphor layer on the lower dielectric layer, the phosphor layer including a phosphor material and an additive material, wherein the driver does not supply a sustain signal to at least one of the scan electrode and the sustain electrode during a sustain period of a first subfield of a plurality of subfields of a frame, and supplies a plurality of reset signals to the scan electrode during a reset period of a second subfield following the first subfield, wherein a sustain period of at least one subfield of the plurality of subfields of the frame is omitted.

BRIEF DESCRIPTION OF THE DRAWINGS

The accompany drawings, which are included to provide a further understanding of the invention and are incorporated on and constitute a part of this specification, illustrate embodiments of the invention and together with the description serve to explain the principles of the invention. In the drawings.

DETAILED DESCRIPTION

Reference will now be made in detail embodiments of the invention examples of which are illustrated in the accompanying drawings.

Figure 1:
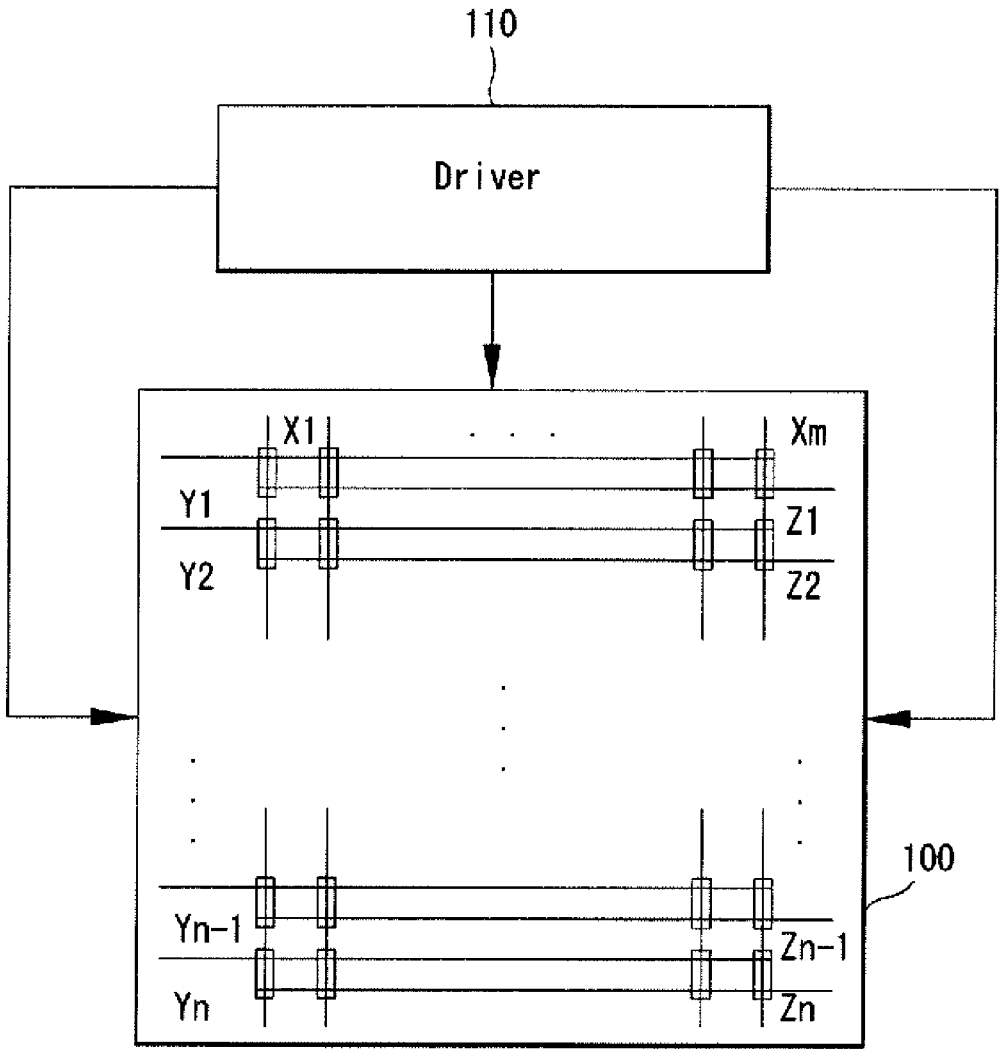
FIG. 1 shows a configuration of a plasma display apparatus according to an exemplary embodiment.

FIG. 1 shows a configuration of a plasma display apparatus according to an exemplary embodiment.

As shown in FIG. 1, the plasma display apparatus according to the exemplary embodiment includes a plasma display panel 100 and a driver 110.

The plasma display panel 100 includes scan electrodes Y1-Yn and sustain electrodes Z1-Zn positioned parallel to each other, and address electrodes X1-Xm positioned to intersect the scan electrodes Y1-Yn and the sustain electrodes Z1-Zn. The driver 110 supplies a driving signal to at least one of the scan electrode, the sustain electrode, or the address electrode to display thereby an image on the screen of the plasma display panel 100.

Figure 2:
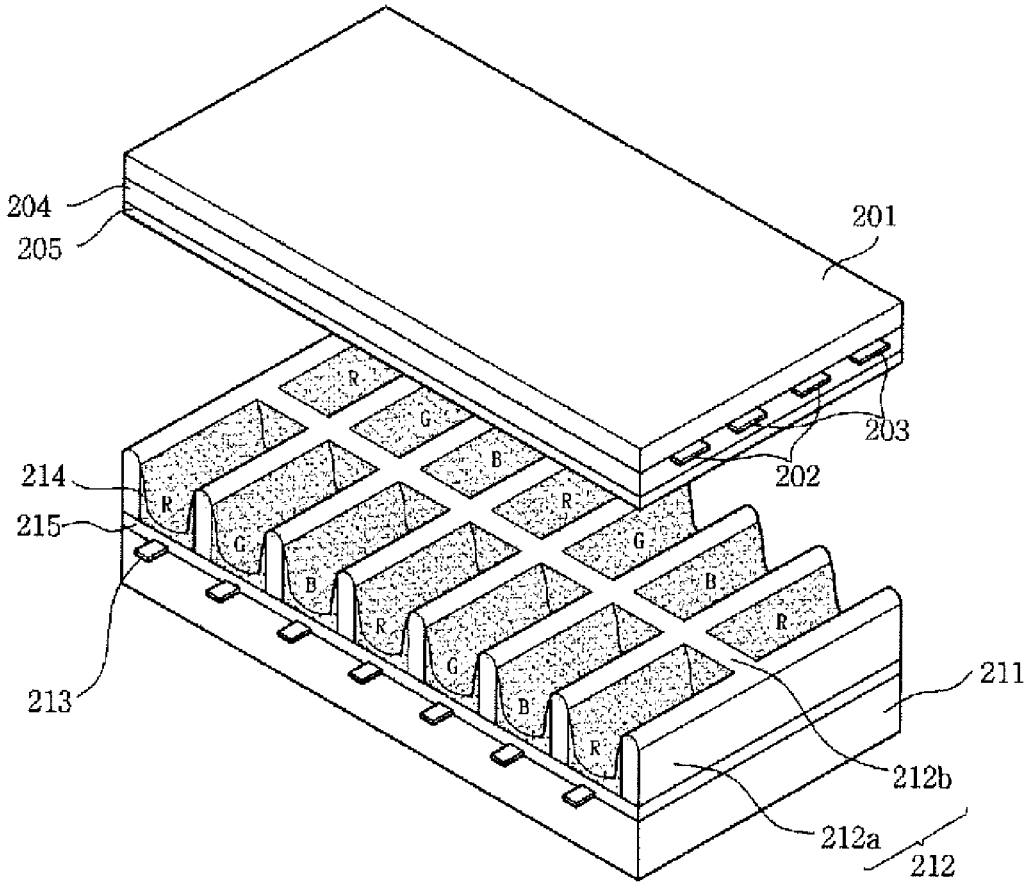
FIG. 2 shows a structure of a plasma display panel according to the exemplary embodiment.

FIG. 2 shows a structure of a plasma display panel according to the exemplary embodiment.

As shown in FIG. 2, the plasma display panel 100 according to the exemplary embodiment may include a front substrate 201, on which a scan electrode 202 and a sustain electrode 203 are positioned parallel to each other, and a rear substrate 211 on which an address electrode 213 is positioned to intersect the scan electrode 202 and the sustain electrode 203.

An upper dielectric layer 204 may be positioned on the scan electrode 202 and the sustain electrode 203 to limit a discharge current of the scan electrode 202 and the sustain electrode 203 and to provide electrical insulation between the scan electrode 202 and the sustain electrode 203. A protective layer 205 may be positioned on the upper dielectric layer 204 to facilitate discharge conditions.

A lower dielectric layer 215 may be positioned on the address electrode 213 to cover the address electrode 213 and to provide electrical insulation of the address electrodes 213.

Barrier ribs 212 of a stripe type, a well type, a delta type, a honeycomb type, and the like, may be positioned on the lower dielectric layer 215 to partition discharge spaces (i.e., discharge cells). Hence, red, green, and blue discharge cells, and the like, may be positioned between the front substrate 201 and the rear substrate 211.

Each of the discharge cells partitioned by the barrier ribs 212 may be filled with a discharge gas. A phosphor layer 214 may be positioned inside the discharge cells partitioned by the barrier ribs 212 to emit visible light for an image display during an address discharge. For instance, red, green, and blue phosphor layers may be positioned inside the discharge cells.

Figure 3:
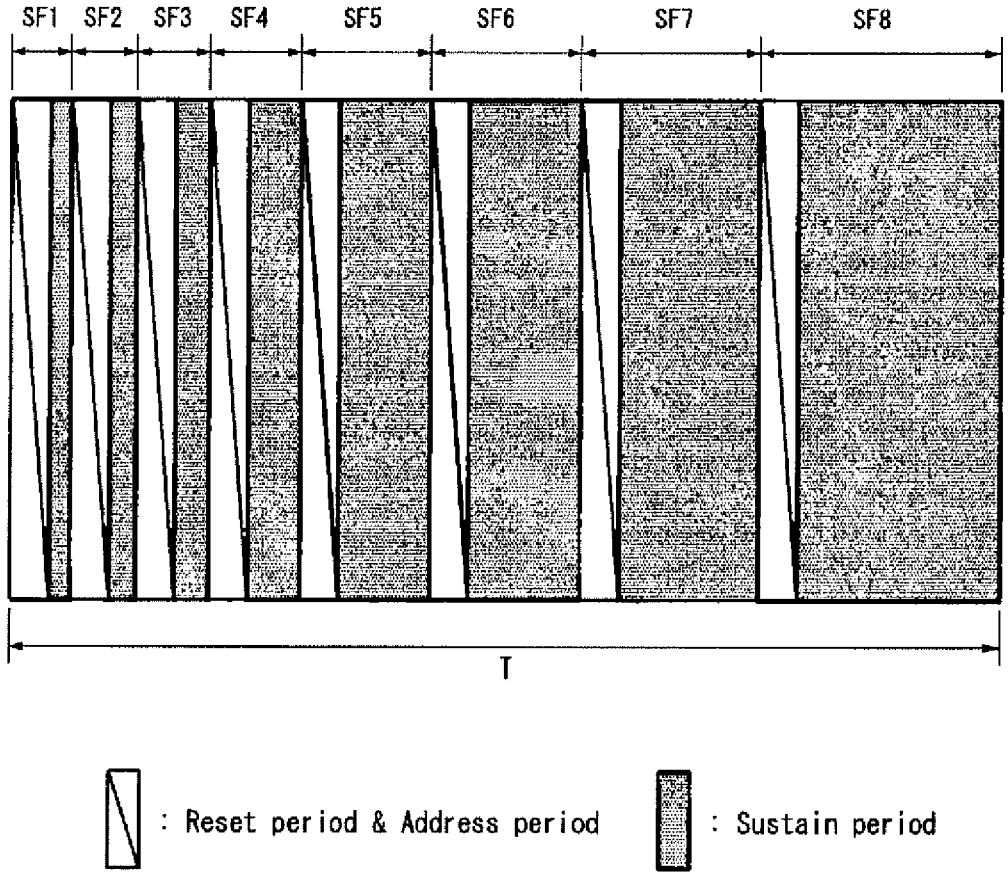
FIG. 3 shows a frame for achieving a gray level of an image in the plasma display apparatus.

FIG. 3 shows a frame for achieving a gray level scale of an image in the plasma display apparatus.

As shown in FIG. 3, a frame for achieving a gray scale of an image displayed by the plasma display apparatus according to the exemplary embodiment is divided into several subfields each having a different number of emission times.

Each subfield is subdivided into a reset period for initializing all the cells, an address period for selecting cells to be discharged, and a sustain period for representing gray level in accordance with the number of discharges.

For example, if an image with 256 gray levels is to be displayed, a frame, as shown in FIG. 3, is divided into 8 subfields SF1 to SF8. Each of the 8 subfields SF1 to SF8 is subdivided into a reset period, an address period, and a sustain period.

The number of sustain signals supplied during the sustain period determines a subfield weight of each subfield. For example, in such a method of setting a subfield weight of a first subfield SF1 at $2^0$ and a subfield weight of a second subfield at $2^1$, a subfield weight of each subfield increases in a ratio of $2^n$ (where, n=0, 1, 2, 3, 4, 5, 6, 7). Various images can be displayed by controlling the number of sustain signals supplied during a sustain period of each subfield depending on a subfield weight of each subfield.

The plasma display apparatus uses a plurality of frames to display an image. For instance, 60 frames are used to display an image for 1 second. In this case, a length T of a frame is 1/60 second (i.e., 16.67 ms).

Although FIG. 3 has shown and described the case where one frame includes 8 subfields, the number of subfields constituting one frame may vary. For example, one frame may include 10 or 12 subfields.

Although FIG. 3 has shown and described the case where one frame includes 8 subfields, the number of subfields constituting one frame may vary. For example, one frame may include 12 subfields or 10 subfields.

Further, although FIG. 3 has illustrated and described the subfields arranged in increasing order of subfield weights in one frame, the subfields may be arranged in decreasing order of subfield weights, or the subfields may be arranged regardless of subfield weights.

Figure 4:
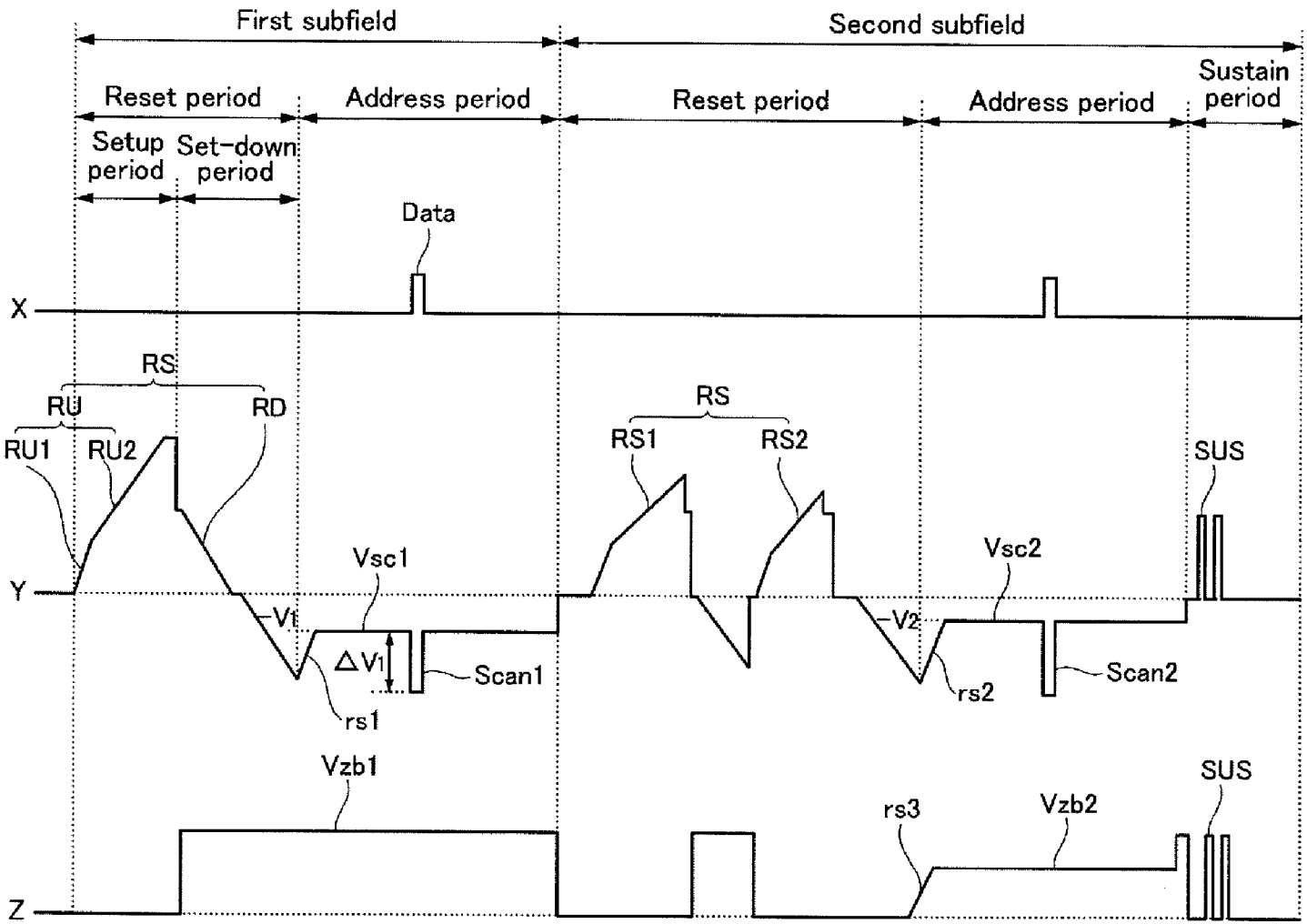
FIGS. 4 and 5 are diagrams for explaining an example of an operation of the plasma display apparatus.
Figure 5:
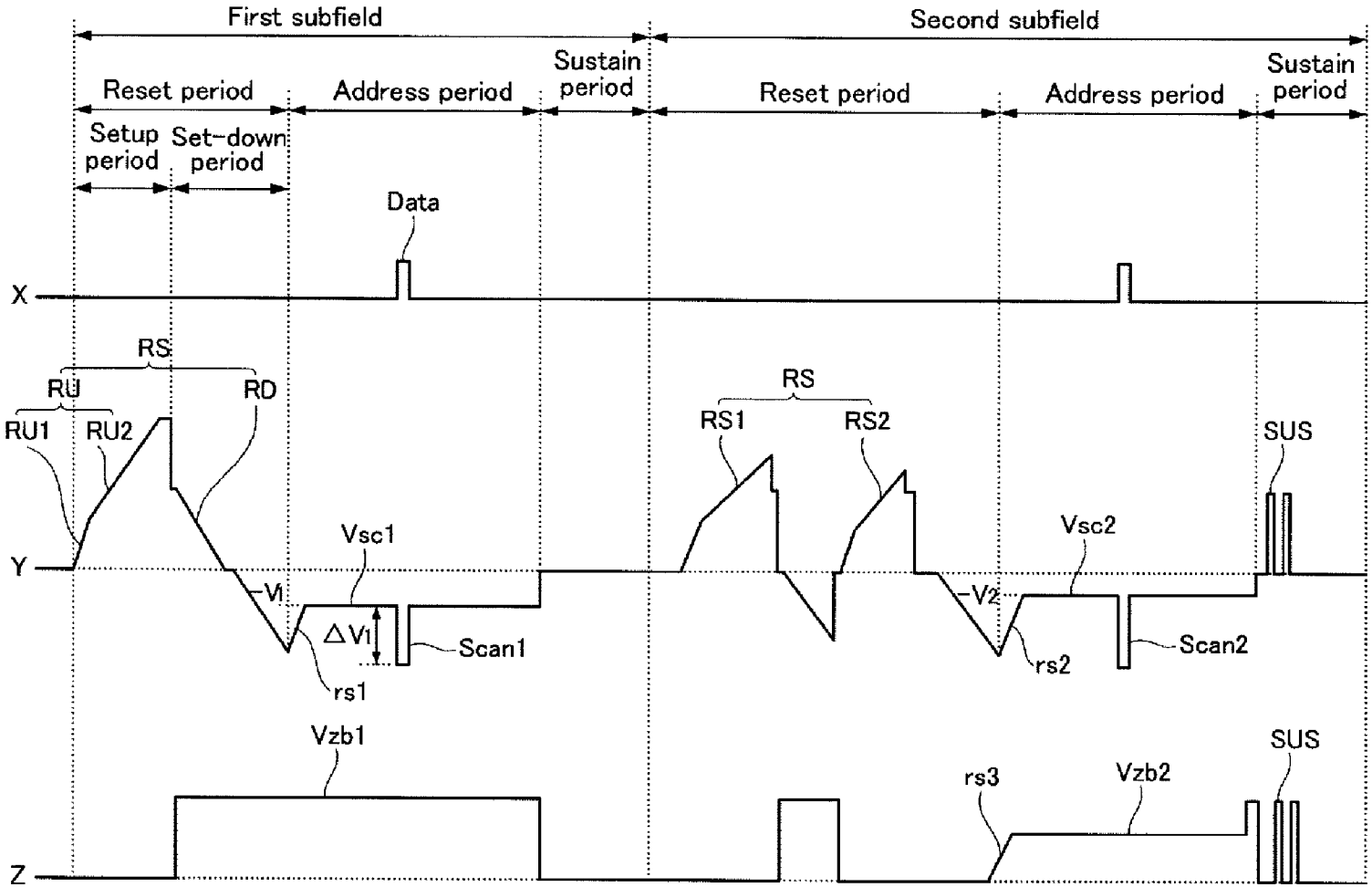

FIGS. 4 and 5 are diagrams for explaining an example of an operation of the plasma display apparatus.

In FIGS. 4 and 5, a first subfield and a second subfield may be first arranged two subfields among a plurality of subfields of a frame in time order. Another subfield may be positioned prior to the first subfield.

As shown in FIG. 4, during a reset period for initialization of a first subfield, a reset signal RS may be supplied to the scan electrode Y. The reset signal RS includes a rising signal RU and a falling signal RD.

The rising signal RU is supplied to the scan electrode Y during a setup period of the reset period, thereby generating a weak dark discharge (i.e., a setup discharge) inside the discharge cell. Hence, a proper amount of wall charges may be accumulated inside the discharge cell.

Then, the falling signal RD is supplied to the scan electrode Y during a set-down period of the reset period, thereby generating a weak erase discharge (i.e., a set-down discharge) inside the discharge cell. Hence, the remaining wall charges are uniform inside the discharge cells to the extent that an address discharge occurs stably.

The rising signal RU may include a first rising signal RU1 and a second rising signal RU2. A slope of the first rising signal RU1 may be larger than a slope of the second rising signal RU2. The two rising signals can rapidly raise a voltage of the scan electrode before the generation of the setup discharge, and relatively slowly raise a voltage of the scan electrode during the generation of the setup discharge. Hence, an excessive increase in a time width of the setup period can be prevented, and also the setup discharge can occur more stably.

During an address period following the reset period, a first scan bias signal Vsc1 may be supplied to the scan electrode Y. The first scan bias signal Vsc1 is substantially maintained at a voltage —V1 higher than a lowest voltage of the falling signal RD.

A first rising signal rs1 may be supplied to the scan electrode Y between the falling signal RD and the first scan bias signal Vsc1. The supply of the first rising signal rs1 reduces a coupling effect of the adjacent electrodes, and thus can reduce the generation of noise.

During the address period, a first scan signal Scan1 falling from the first scan bias signal Vsc1 may be supplied to the scan electrode Y, and at the same time, a data signal Data corresponding to the first scan signal Scan1 may be supplied to the address electrode X.

As a voltage difference between the scan signal Scan1 and the data signal Data is added to a wall voltage by wall charges produced during the reset period, an address discharge may occur inside the discharge cells to which the data signal Data is supplied.

A first sustain bias signal Vzb1 may be supplied to the sustain electrode Z during the address period so as to prevent the address discharge from unstably occurring by interference of the sustain electrode Z.

A voltage of the first sustain bias signal Vzb1 may be substantially equal to a voltage of a sustain signal SUS supplied to at least one of the scan electrode Y or the sustain electrode Z during a sustain period of the second subfield following the first subfield.

In FIG. 4, the first subfield does not include a sustain period, and thus a reset period of the second subfield follows the address period of the first subfield.

As shown in FIG. 5, although a first subfield may include a sustain period following an address period, a sustain signal may not be supplied during the sustain period of the first subfield.

Figure 6:
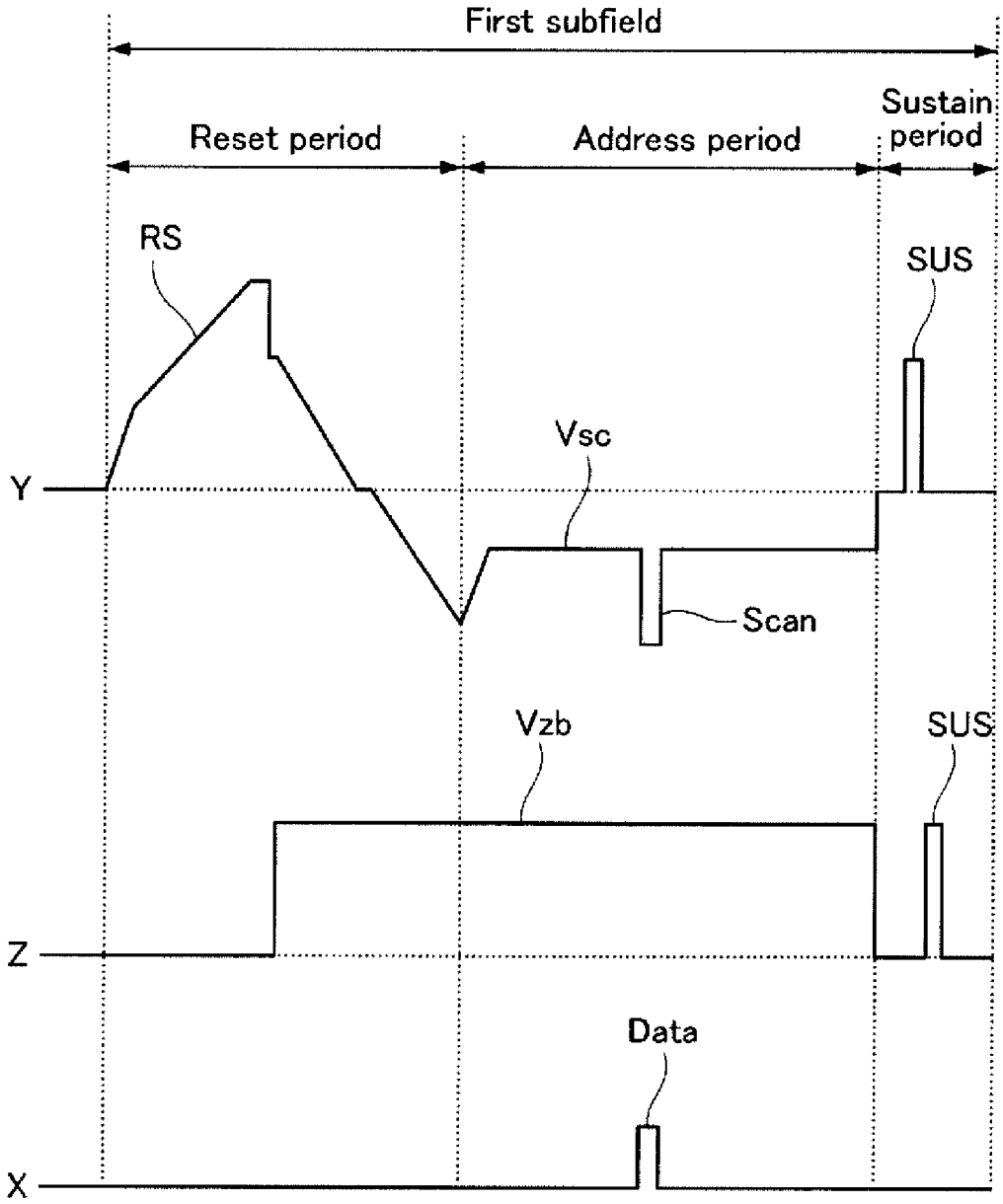
FIGS. 6 to 8 are diagrams for explaining a reason why a sustain signal is not supplied.
Figure 7:
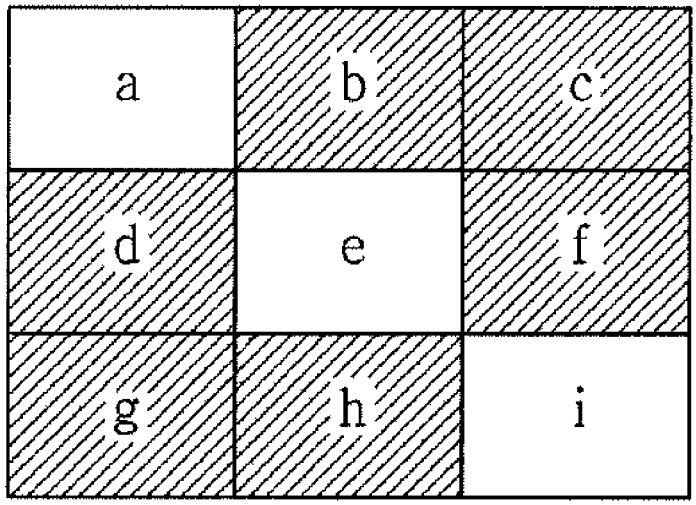
Figure 8:
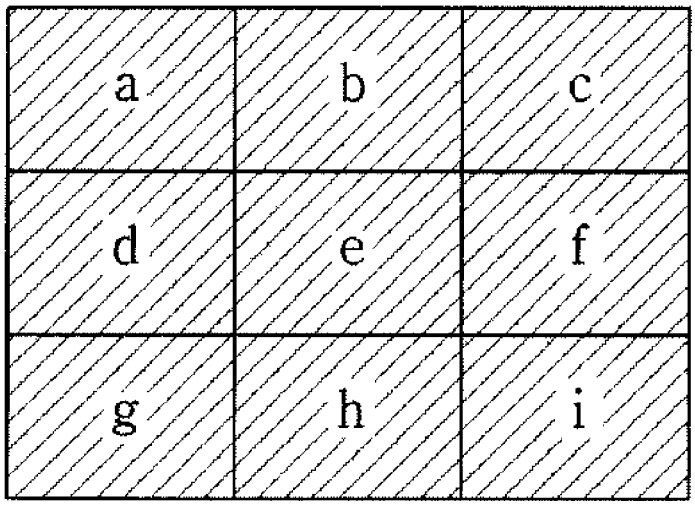

FIGS. 6 to 8 are diagrams for explaining a reason why a sustain signal is not supplied.

FIG. 6 shows a case where sustain signals SUS are supplied to the scan and sustain electrodes during a sustain period of a first subfield, respectively. In this case, a gray level of the first subfield may be achieved through light emitted during reset, address, and sustain periods.

It is assumed that a gray level of light produced by one sustain signal is 0.5, a gray level of light produced by data and scan signals is 0.5, and light emitted during the reset period is negligible. The assumption is arbitrary set for the convenience of explanation.

In this case, if an image with 0.5 gray level is to be displayed on an area including a total of 9 (3×3) discharge cells, as shown in FIG. 7, three discharge cells a, e, and i of the 9 discharge cells a to i may be turned on. Hence, a gray level of light generated in the area including the 9 discharge cells is 4.5 (=1.5×3), and thus a gray level of an image displayed on each of the 9 discharge cells may be understood to be 0.5. However, such a method may cause the deterioration of the image quality (for example, a specific pattern on the screen).

As shown in FIGS. 4 and 5, when a sustain period is omitted or a sustain signal is not supplied during a sustain period, a gray level of an image capable of displaying in the first subfield is 0.5.

Accordingly, if an image with 0.5 gray level is to be displayed on the area including the 9 discharge cells, as shown in FIG. 8, all the 9 discharge cells are turned on. Hence, because a specific pattern is not displayed on the screen, the image quality can be improved.

Figure 9:
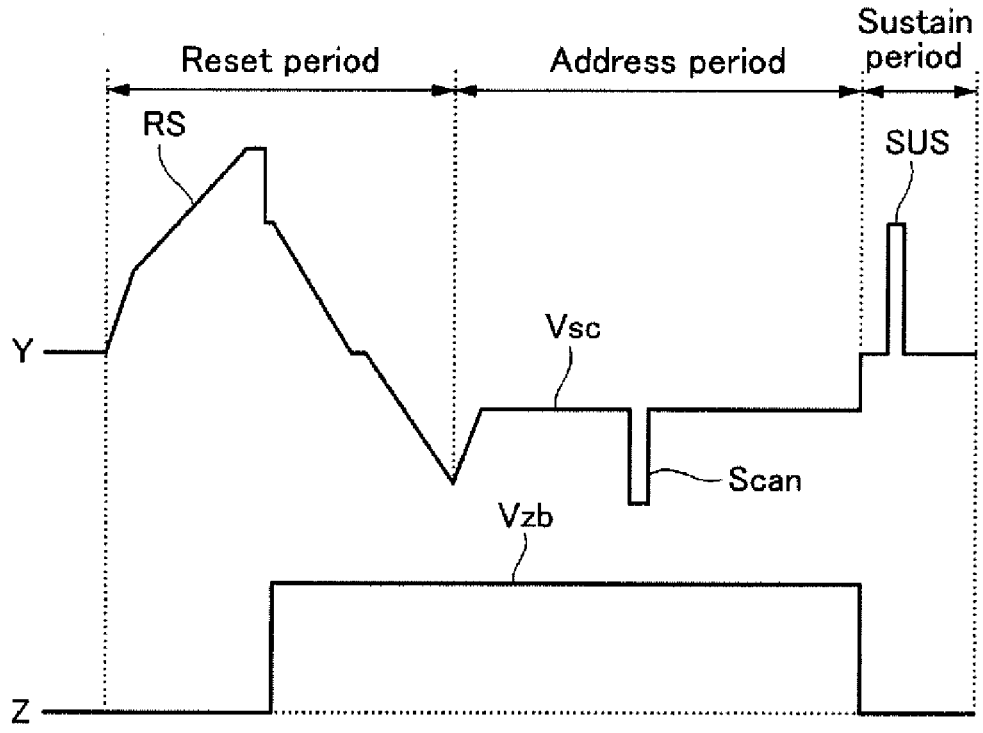
FIG. 9 is a diagram for explaining an example of a method in which a sustain signal is not supplied.
Figure 9:
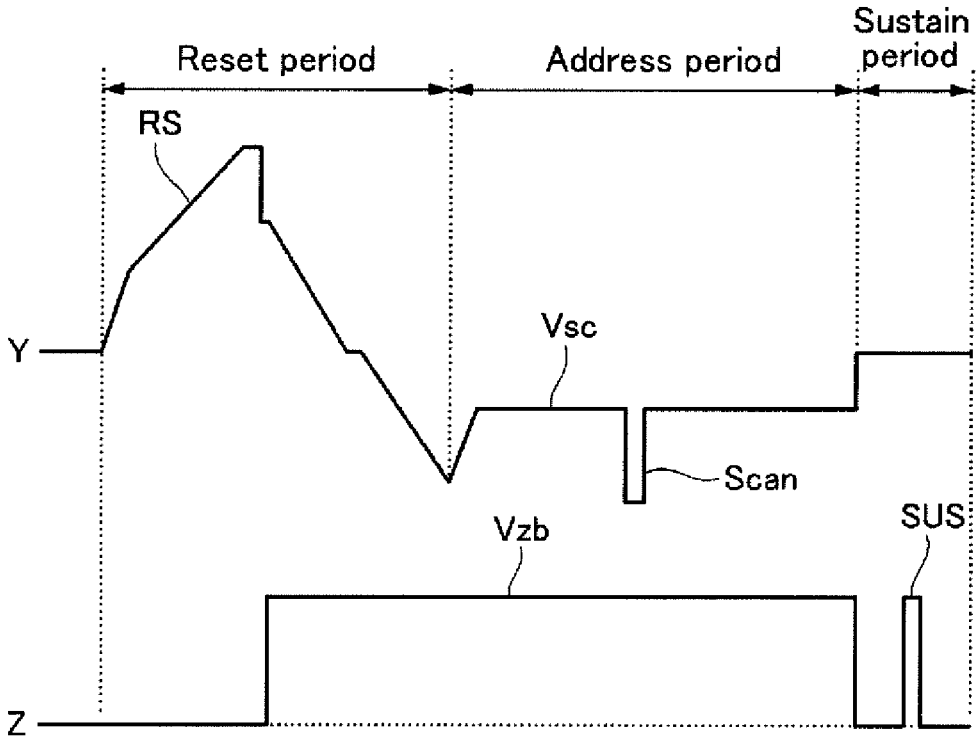

FIG. 9 is a diagram for explaining an example of a method in which a sustain signal is not supplied.

As shown in (a) of FIG. 9, one sustain signal may be supplied to the scan electrode Y and a sustain signal may be not supplied to the sustain electrode Z during a sustain period of a first subfield. Otherwise, as shown in (b) of FIG. 9, one sustain signal may be supplied to the sustain electrode Z and a sustain signal may be not supplied to the scan electrode Y during a sustain period of a first subfield. The image quality in the case of FIG. 9 can be improved as compared with the case where sustain signals are supplied to the scan sustain electrodes during a sustain period, respectively.

Referring again to FIGS. 4 and 5, a plurality of reset signals (i.e., first and second reset signals RS1 and RS2) may be supplied to the scan electrode Y in the second subfield so as to uniform a state of wall charges distributed inside the discharge cells after the first subfield in which the sustain signal is not supplied. Hence, a reset discharge can occur more stably during the reset period of the second subfield.

A second rising signal rs2 may be supplied to the scan electrode Y between the second reset signal RS2 and a second scan bias signal Vsc2. The supply of the second rising signal rs2 reduces a coupling effect of the adjacent electrodes, and thus can reduce the generation of noise.

A third rising signal rs3 corresponding to the second rising signal rs2 may be supplied to the sustain electrode Z. Hence, the generation of noise can be reduced.

During the sustain period of the second subfield, sustain signals may be supplied to at least one of the scan electrode or the sustain electrode. For instance, sustain signals SUS may be alternately supplied to the scan electrode and the sustain electrode.

As the wall voltage inside the discharge cell selected by performing the address discharge is added to a voltage of the sustain signal SUS, every time the sustain signal SUS is supplied, a sustain discharge, i.e., a display discharge occurs between the scan electrode Y and the sustain electrode Z.

Figure 10:
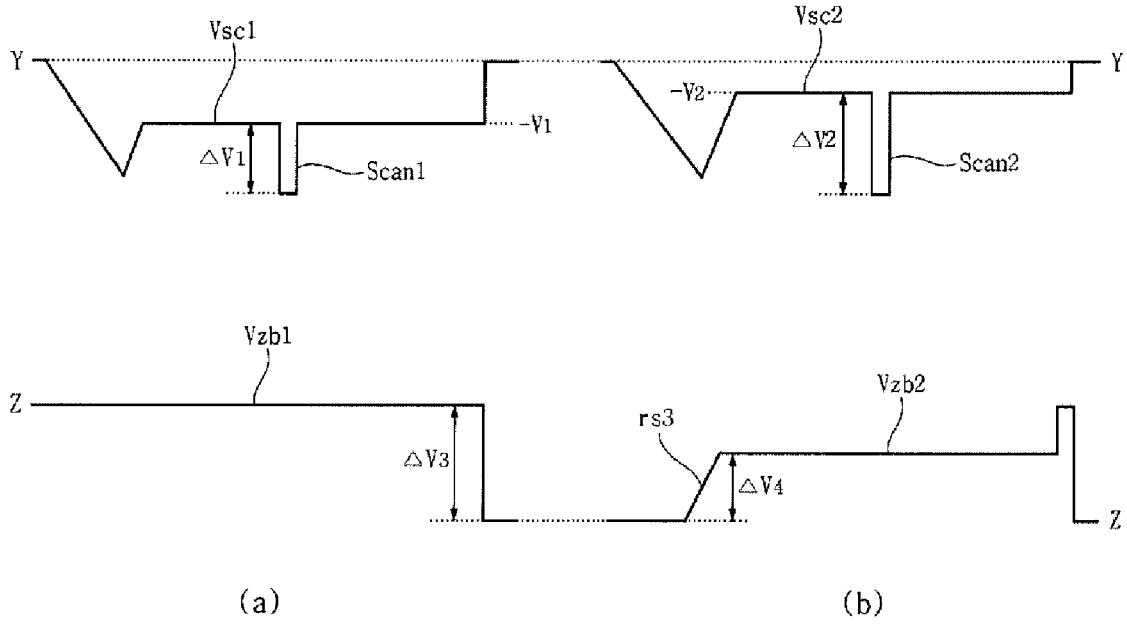
FIG. 10 is a diagram for explaining a voltage difference between a scan electrode and a sustain electrode during an address period.

FIG. 10 is a diagram for explaining a voltage difference between a scan electrode and a sustain electrode during an address period.

As shown in FIG. 10, a voltage difference between the scan electrode Y and the sustain electrode Z during an address period of a first subfield in (a) may be larger than a voltage difference between the scan electrode Y and the sustain electrode Z during an address period of a second subfield in (b). Hence, an address discharge can occur more stably in the first subfield in which a sustain signal is not supplied, and a gray level of the first subfield may be set more clearly.

For instance, it is assumed that a gray level of light produced by an address discharge in the first subfield is 0.2. Because a sustain signal is not supplied in the first subfield, a gray level capable of being achieved in the first subfield may be approximately 0.2. In this case, because 0.2 gray level achieved in the first subfield is very small, a viewer cannot recognize a difference between gray levels of the first and second subfields. Hence, the image quality may worsen, and thus the representability of gray level may be reduced.

On the other hand, the amount of light produced by the address discharge can increase by increasing the voltage difference between the scan electrode Y and the sustain electrode Z during the address period of the first subfield. Accordingly, a gray level of the first subfield can be achieved to the extent that the viewer can recognize, and thus the representability of gray level may be reduced.

A voltage magnitude ΔV3 of a first sustain bias signal Vzb1 supplied to the sustain electrode Z in the first subfield may be larger than a voltage magnitude ΔV4 of a second sustain bias signal Vzb2 supplied to the sustain electrode Z in the second subfield, so that the voltage difference between the scan and sustain electrodes Y and Z during the address period of the first subfield is larger than the voltage difference between the scan and sustain electrodes Y and Z during the address period of the second subfield.

A voltage level −V1 of a first scan bias signal Vsc1 supplied to the scan electrode Y in the first subfield may be lower than a voltage level −V2 of a second scan bias signal Vsc2 supplied to the scan electrode Y in the second subfield.

A voltage magnitude ΔV1 of a first scan signal Scan1 supplied to the scan electrode Y in the first subfield Tay be smaller than a voltage magnitude ΔV2 of a second scan signal Scan2 supplied to the scan electrode Y in the second subfield.

Figure 11:
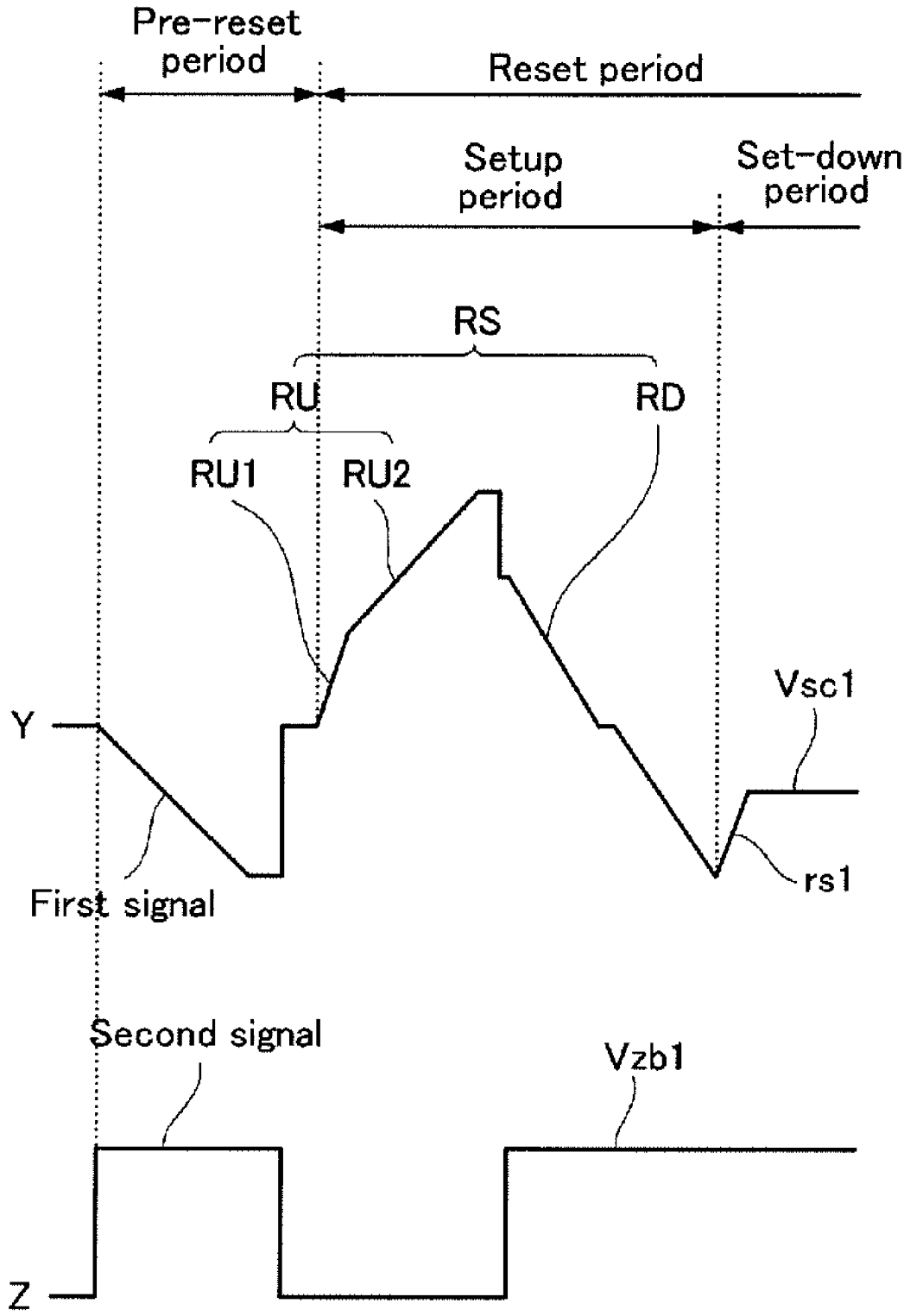
FIG. 11 is a diagram for explaining a pre-reset period.

FIG. 11 is a diagram for explaining a pre-reset period.

As shown in FIG. 11, a first subfield may include a pre-reset period prior to a reset period. During the pre-reset period, a first signal with a polarity opposite a polarity of a reset signal RS supplied to the scan electrode Y during the reset period may be supplied to the scan electrode Y. During the supply of the first signal, a second signal with a polarity opposite the polarity of the first signal may be supplied to the sustain electrode Z.

A voltage magnitude of the second signal may be approximately equal to a voltage of a sustain signal supplied during a sustain period. As above, wall charges with a predetermined polarity may be accumulated on the scan electrode, and wall charges with a polarity opposite the polarity of the wall charges accumulated on the scan electrode may be accumulated on the sustain electrode by supplying the first and second signals to the scan and sustain electrodes during the pre-reset period, respectively. For instance, positive wall charges may be accumulated on the scan electrode, and negative wall charges may be accumulated on the sustain electrode.

Accordingly, a setup discharge with a sufficient intensity may occur during the reset period following the pre-reset period, and thus the initialization of wall charges can be performed stably during the reset period. Further, although a voltage of a rising signal RU supplied to the scan electrode Y during the reset period is low, a setup discharge with a sufficient intensity may occur.

A first arranged subfield among a plurality of subfields of a frame may include a pre-reset period or two or three subfields may include a pre-reset period so as to secure drive time.

Figure 12:
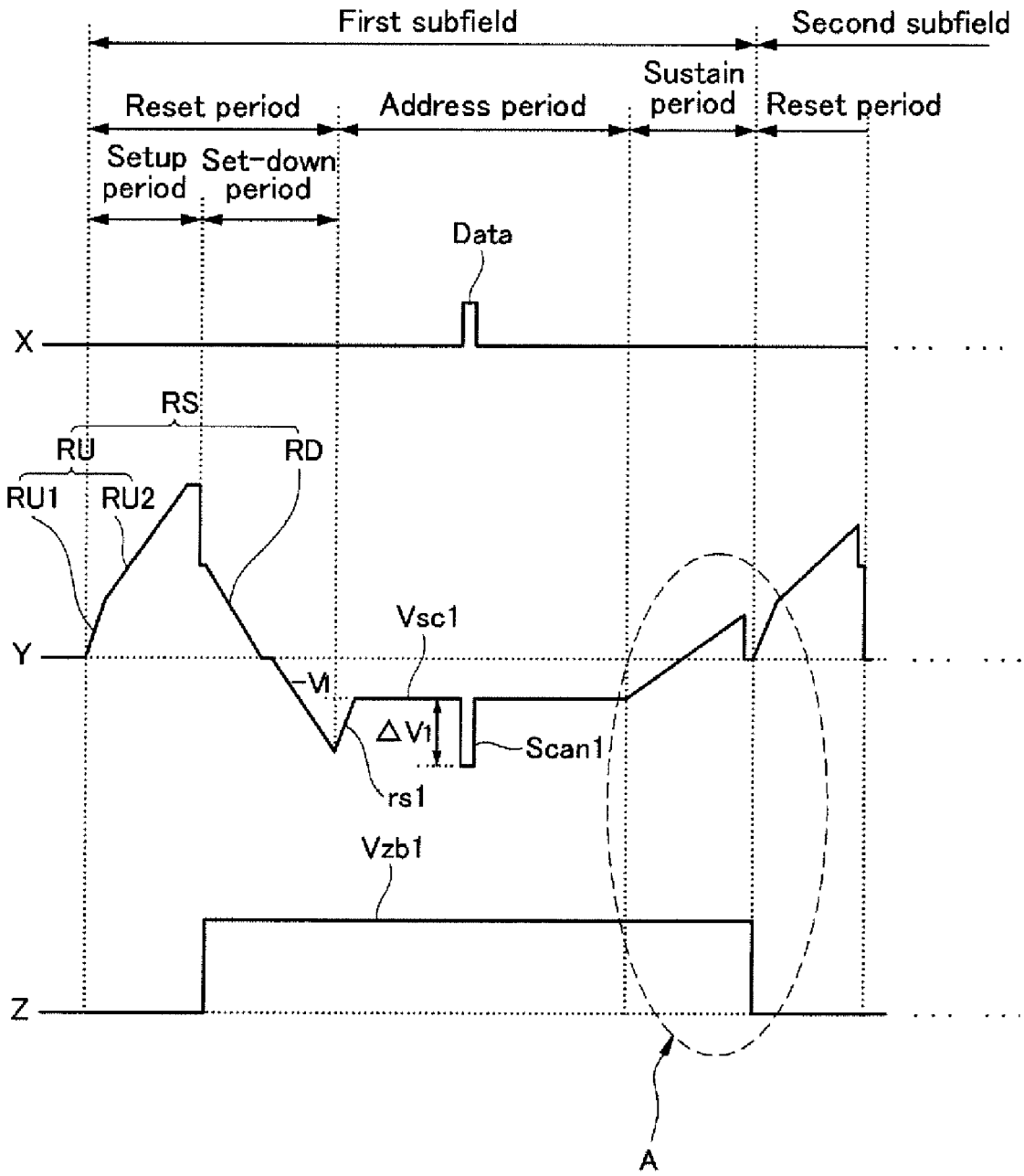
FIGS. 12 and 13 are diagrams for explaining an example of a self-erase prevention signal.
Figure 13:
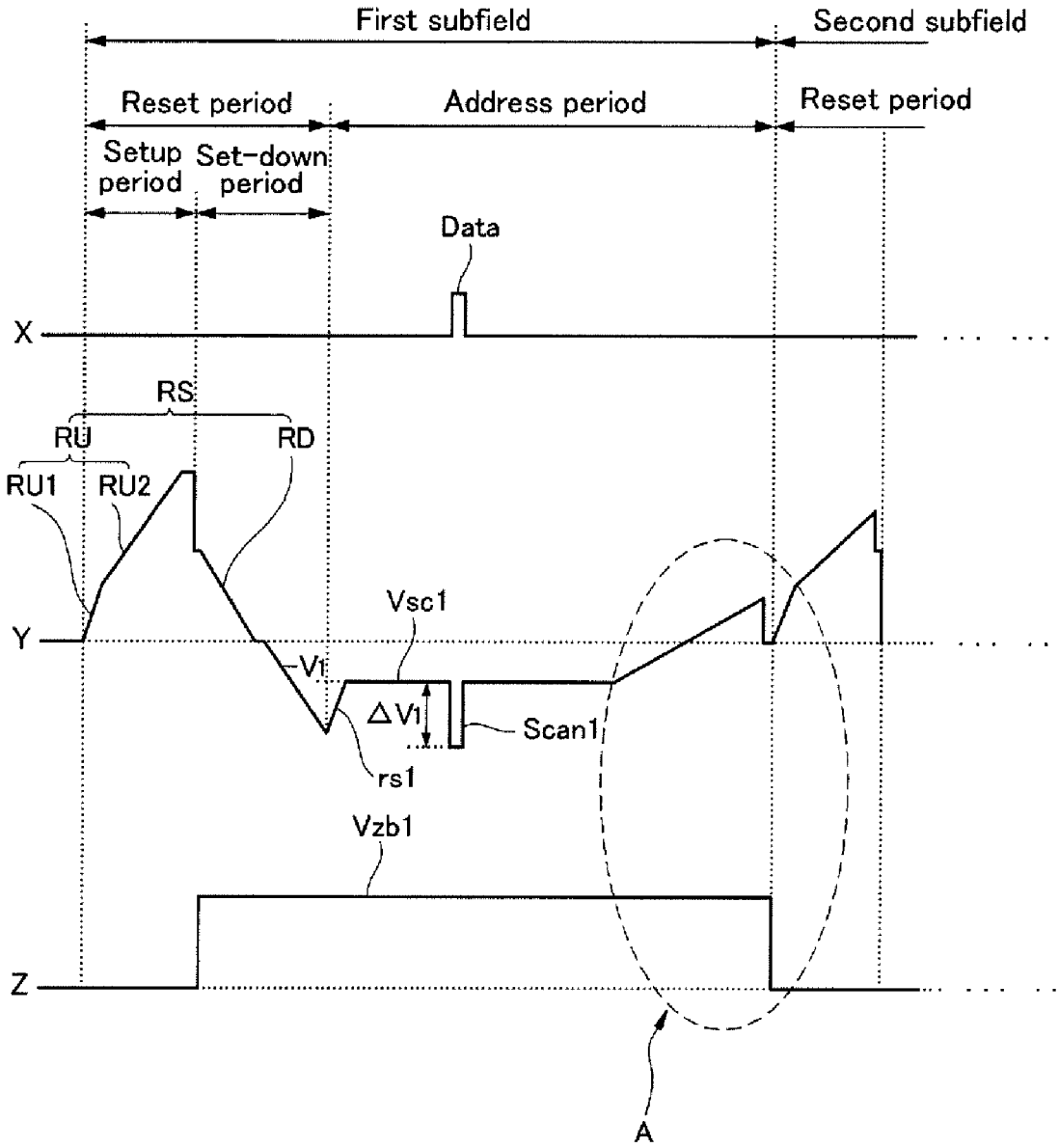

FIGS. 12 and 13 are diagrams for explaining an example of a self-erase prevention signal.

During an address period of a subfield not including a sustain period or a subfield in which a sustain signal is not supplied to any one of the scan and sustain electrodes during a sustain period, a voltage difference between a bias voltage and a scan reference voltage may be relatively large. Therefore, it is a great likelihood of the generation of a self-erase discharge between the address period and a reset period of a next subfield. Accordingly, after the supply of a data signal during the address period, a self-erase prevention signal may be supplied so as to prevent the generation of the self-erase discharge prior to the reset period of the next subfield.

As shown in FIG. 12, a self-erase prevention signal A is supplied during a sustain period of a first subfield in which a sustain signal is not supplied during the sustain period.

As shown in FIG. 13, a self-erase prevention signal A is supplied during an address period of a first subfield not including a sustain period.

The self-erase prevention signal A may include a rising signal with a gradually rising voltage. The rising signal is supplied to the scan electrode Y during the supply of the sustain bias voltage Vzb1 to the sustain electrode Z. As the voltage difference between the scan bias voltage Vsc1 and the sustain bias voltage Vzb1 increases, a slope of the rising signal increases.

For instance, it is assumed that rising signals of self-erase prevention signals having an equal slope are supplied in two cases where a voltage difference between the scan bias voltage Vsc1 and the sustain bias voltage Vzb1 is 400V and 600V, respectively. Time required to reduce the voltage difference in the case of the voltage difference of 600V is longer than time required to reduce the voltage difference in the case of the voltage difference of 400V.

Therefore, a total time width of a subfield in the case of the voltage difference of 400V is different from a total time width of a subfield in the case of the voltage difference of 600V. A difference in the total time width may cause a difficulty in securing a driving margin. For this reason, the slope of the rising signal may increase as the voltage difference between the scan bias voltage Vsc1 and the sustain bias voltage Vzb1 increases.

It is assumed that after a data signal is supplied in a subfield not including a sustain period or a subfield in which a sustain signal is not supplied during a sustain period, a self-erase prevention signal is not supplied prior to a reset period of a next subfield. A voltage difference between a scan bias voltage Vsc1 and a sustain bias voltage Vzb1 is relatively large in the subfield not including the sustain period or the subfield in which the sustain signal is not supplied. Therefore, voltage levels of the scan and sustain electrodes have to be set at a ground level voltage GND so that a reset signal is supplied during a sustain period following the address period or in a next subfield. For this, the voltage difference between the scan bias voltage Vsc1 and the sustain bias voltage Vzb1 during the address period has to be overcome.

For instance, supposing that the scan bias voltage Vsc1 and a sustain voltage Vs are −200V and +200V during the address period, respectively, a wall voltage (for example, 300V) with a sufficient magnitude is generated inside the discharge cell due to a voltage difference of 400V. If a voltage difference between the scan and sustain electrodes Y and Z is reduced to 0V, a discharge occurs inside the discharge cell due to a wall voltage (for example, 300V) with a sufficient magnitude.

If a discharge occurs due to only the wall voltage inside the discharge cell in a state where a voltage is not supplied from the outside, the most of wall charges inside the discharge cell may be erased. Hence, it is difficult to use the wall charges inside the discharge cell in a subsequent reset discharge, and thus it is a great likelihood of the generation of an erroneous discharge. The self-erase prevention signal A is supplied between an address period of a subfield and a reset period of a next subfield so as to prevent the erroneous discharge.

Figure 14:
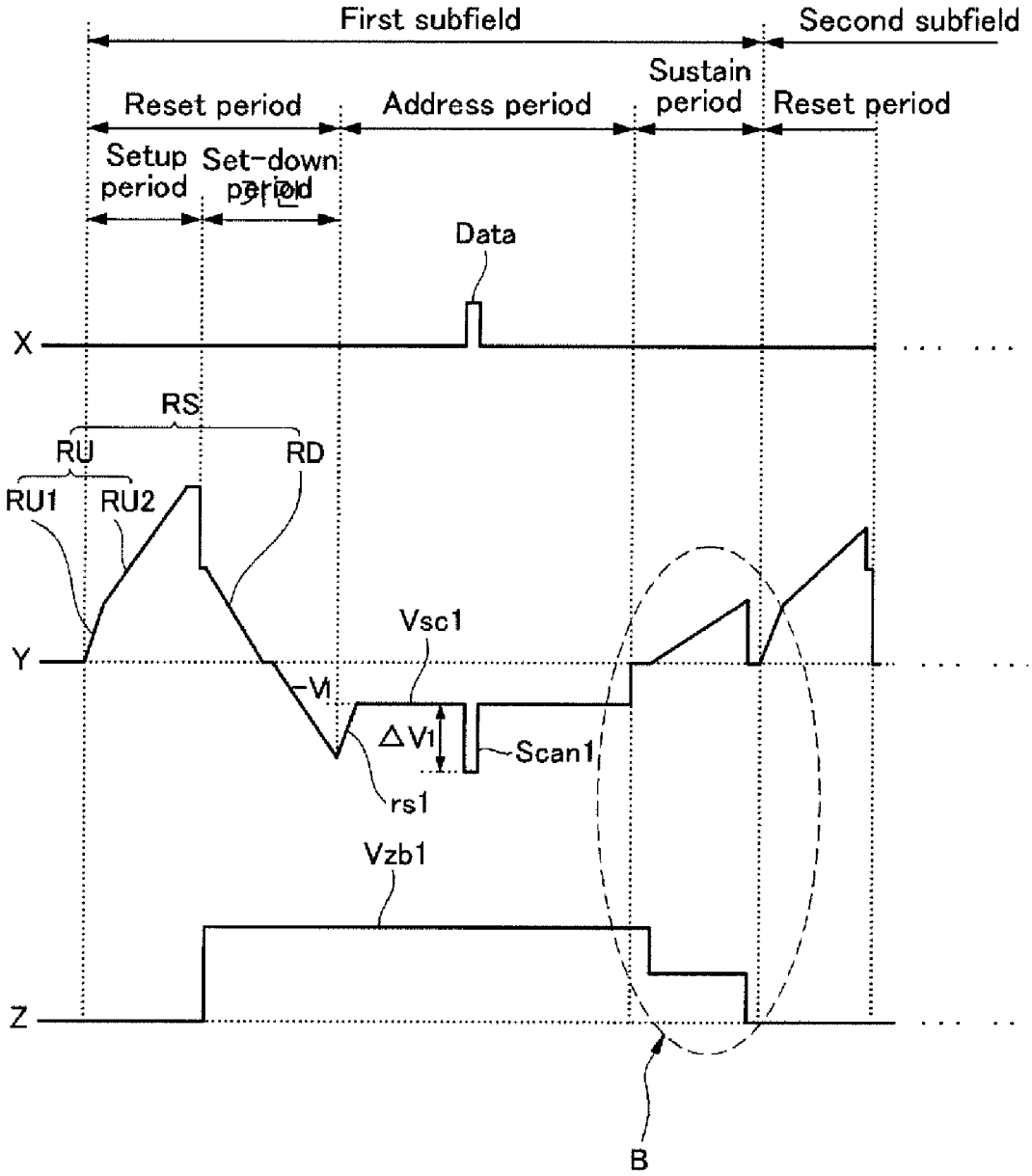
FIGS. 14 and 15 are diagrams for explaining another example of a self-erase prevention signal.
Figure 15:
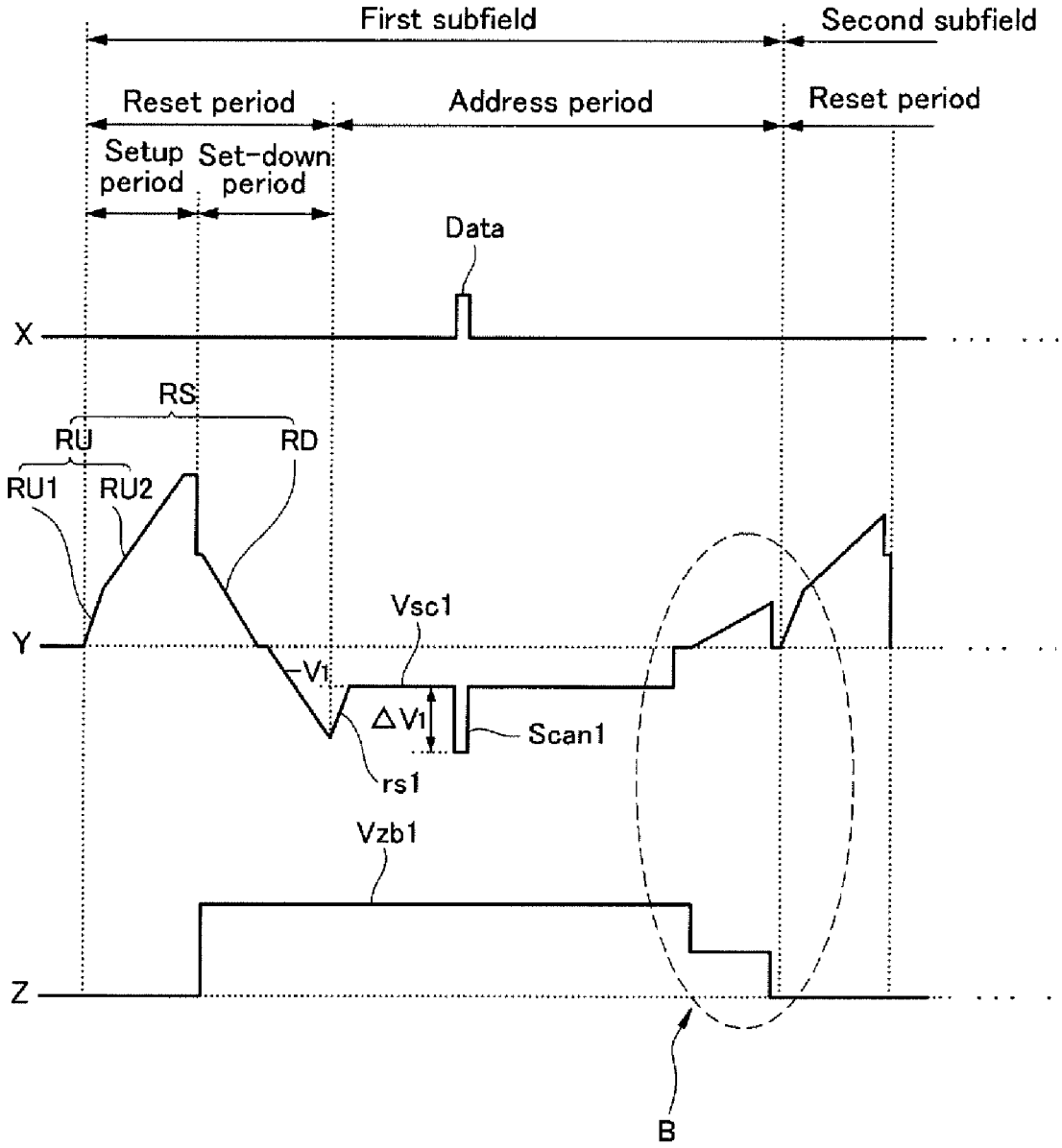

FIGS. 14 and 15 are diagrams for explaining another example of a self-erase prevention signal.

Unlike the self-erase prevention signal A of FIGS. 12 and 13, a self-erase prevention signal B of FIGS. 14 and 15 includes a rising signal supplied to the scan electrode Y and a signal with a positive voltage supplied to the sustain electrode Z during the supply of the rising signal. The positive voltage is higher than the ground level voltage GND and lower than the sustain voltage.

In FIG. 14, in case that a sustain signal is not supplied during a sustain period of a subfield with a low gray level, a self-erase prevention signal is supplied during the sustain period. In FIG. 15, a self-erase prevention signal is supplied during an address period of a subfield with a low gray level not including a sustain period.

It may be advantageous that the positive voltage of the self-erase prevention signal B is one half Vzb1/2 of a bias voltage Vzb1 supplied to the sustain electrode Z in a subfield in which a sustain signal is not supplied or in a subfield not including a sustain period, i.e., in a first subfield with a low gray level.

Figure 16:
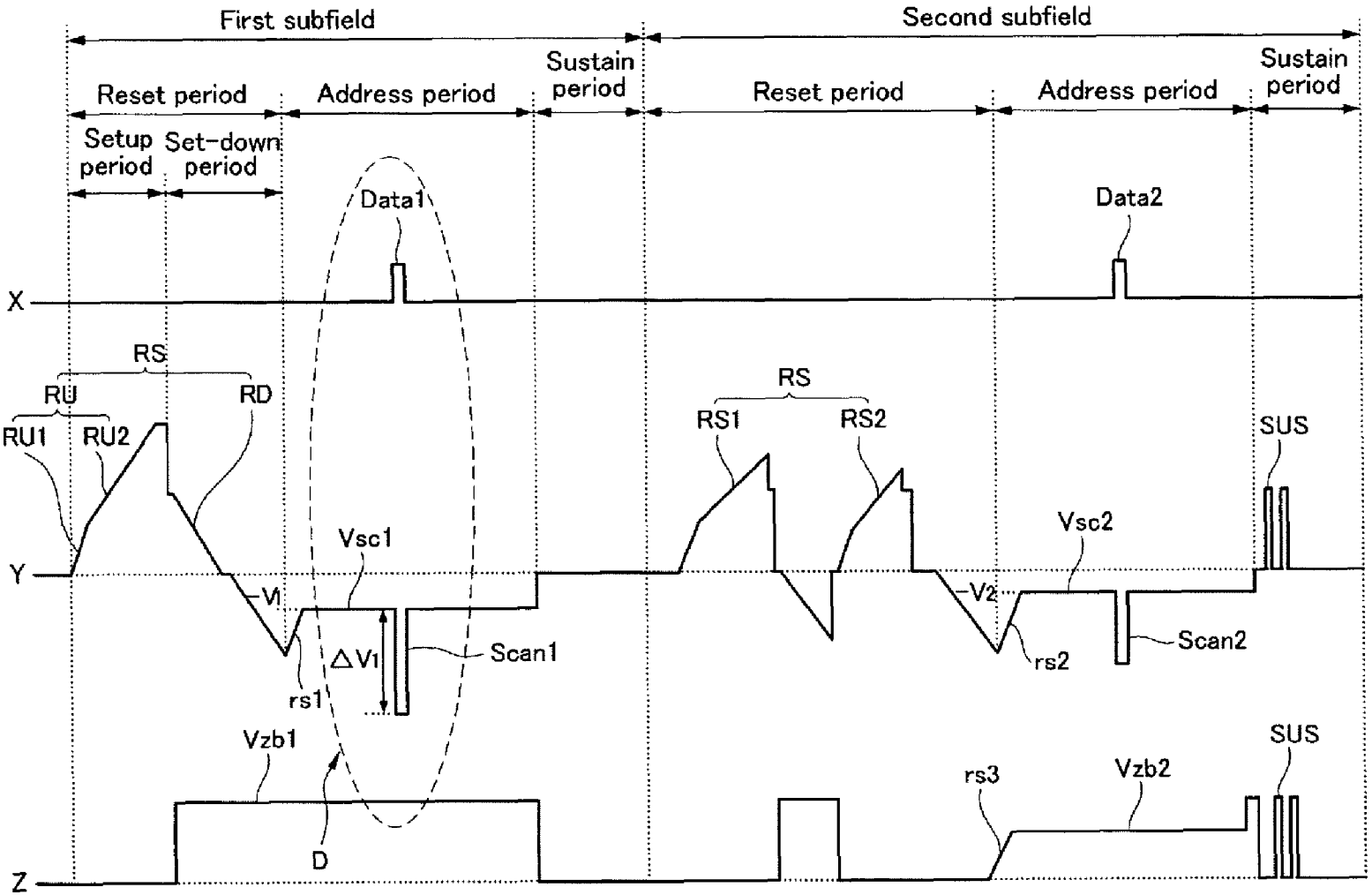
FIGS. 16 and 17 are diagrams for explaining an implementation of a method of driving the plasma display panel.
Figure 17:
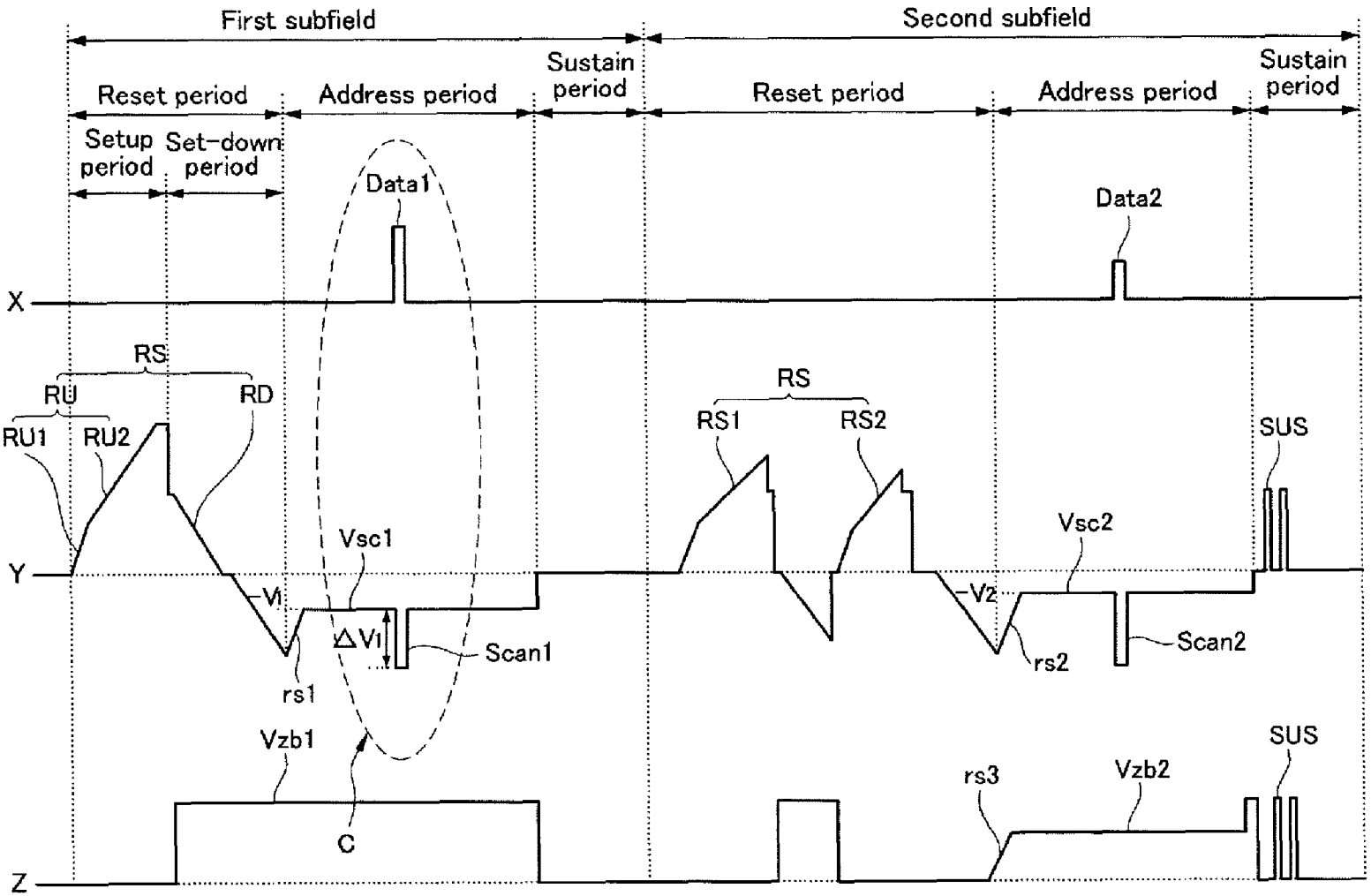

FIGS. 16 and 17 are diagrams for explaining an implementation of a method of driving the plasma display panel.

As shown in FIG. 16, a sustain signal may not be supplied to at least one of the scan electrode Y or the sustain electrode Z during a sustain period of a first subfield with a low gray level among a plurality of subfields of a frame. Otherwise, the first subfield may not include a sustain period. Further, a voltage magnitude of a scan signal Scan1 supplied in the first subfield is larger than a voltage magnitude of a scan signal Scan2 supplied in another subfield (for example, a second subfield). Hence, a voltage difference between the scan electrode Y and the address electrode X during an address period of the first subfield may be larger than a voltage difference between the scan electrode Y and the address electrode X in another subfield. As a result, an intensity of an address discharge generated during the address period of the first subfield may be larger than an intensity of an address discharge generated in another subfield.

The above-described driving method of the plasma display panel reduces the generation of a halftone noise phenomenon in which an image spreads in a boundary portion of the image, and thus can clearly display the image.

As shown in FIG. 17, a sustain signal may not be supplied to at least one of the scan electrode Y or the sustain electrode Z during a sustain period of a first subfield with a low gray level among a plurality of subfields of a frame. Otherwise, the first subfield may not include a sustain period. Further, a voltage magnitude of a data signal Data1 supplied in the first subfield is larger than a voltage magnitude of a data signal Data2 supplied in another subfield (for example, a second subfield). Hence, a voltage difference between the scan electrode Y and the address electrode X during an address period of the first subfield may be larger than a voltage difference between the scan electrode Y and the address electrode X in another subfield. As a result, an intensity of an address discharge generated during the address period of the first subfield may be larger than an intensity of an address discharge generated in another subfield.

The above-described driving method of the plasma display panel reduces the generation of a halftone noise phenomenon in which an image spreads in a boundary portion of the image, and thus can clearly display the image.

Figure 18:
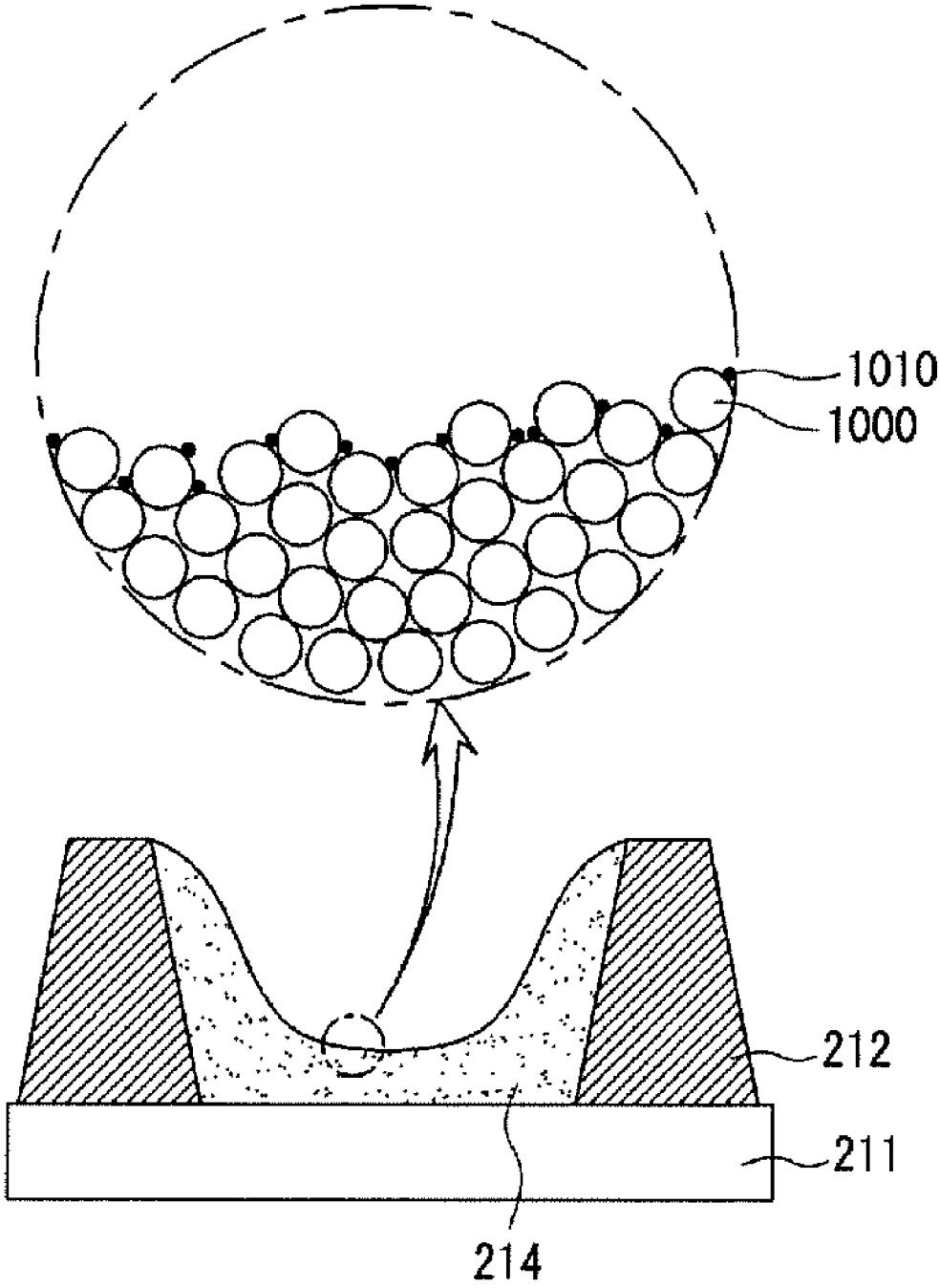
FIG. 18 is a diagram for explaining a phosphor layer including particles of an additive material.

FIG. 18 is a diagram for explaining a phosphor layer including particles of an additive material.

Because a first subfield does not include a sustain period or a sustain signal is not supplied during a sustain period of the first subfield, a distribution state of wall charges at an end of the first subfield may be very unstable.

For instance, it is assumed that an address discharge occurs inside a first discharge cell and an address discharge does not occur inside a second discharge cell in the first subfield. In this case, when a sustain signal is supplied, a sufficient amount of wall charges are accumulated in the first discharge cell to the extent that a sustain discharge can occur. Although a sustain signal is supplied, a small amount of wall charges are accumulated in the second discharge cell to the extent that a sustain discharge does not occur.

If a sustain discharge occurs due to the supply of the sustain signal, the distribution state of wall charges in the first discharge cell changes. Therefore, a smooth reset discharge can occur during a reset period of a second subfield.

However, because the sustain signal is not supplied in the first subfield, a distribution state of wall charges during an address period of the first subfield may be maintained up to the reset period of the second subfield. Hence, a reset discharge in the second subfield may be unstable.

The phosphor layer 214 of the plasma display panel may include particles of a phosphor material and particles of an additive material such as MgO so as to reduce a difference between wall charges of the first and second discharge cells and to stabilize a reset discharge in the second subfield. The additive material can improve a discharge response characteristic between the scan and address electrodes or between the sustain and address electrodes.

In case that the phosphor layer 214 includes the additive material, the additive material acts as a catalyst of a discharge. Hence, a discharge can stably occur between the scan and address electrodes or between the sustain and address electrodes at a relatively low voltage. This is caused by a reason why the particles of the additive material emit a large amount of electrons during a discharge because of a high secondary electron emission coefficient of the additive material.

As shown in FIG. 18, the phosphor layer 214 includes particles 1000 of a phosphor material and particles 1010 of an additive material.

The additive material is not limited particularly except the improvement of the discharge response characteristic between the scan electrode and the address electrode or between the sustain electrode and the address electrode. Examples of the additive material include at least one of magnesium oxide (MgO), zinc oxide (ZnO), silicon oxide ($SiO_2$), titanium oxide ($TiO_2$), yttrium oxide (Y2O3), aluminum oxide ($Al_2O_3$), lanthanum oxide ($La_2O_3$), europium oxide (EuO), cobalt oxide, iron oxide, or CNT (carbon nano tube). It may be advantageous that the additive material is MgO.

At least one of the particles 1000 of the phosphor material on the surface of the phosphor layer 214 may be exposed in a direction toward the center of the discharge cell. For instance, since the particles 1010 of the additive material are disposed between the particles 1000 of the phosphor material on the surface of the phosphor layer 214, at least one particle 1000 of the phosphor material may be exposed.

As described above, when the particles 1010 of the additive material are disposed between the particles 1000 of the phosphor material, a discharge response characteristic between the scan electrode and the address electrode or between the sustain electrode and the address electrode can be improved. Further, since the surface area of the particles 1000 of the phosphor material covered by the particles 1010 of the additive material may be minimized, a reduction in a luminance can be prevented.

Figures 19, 20:
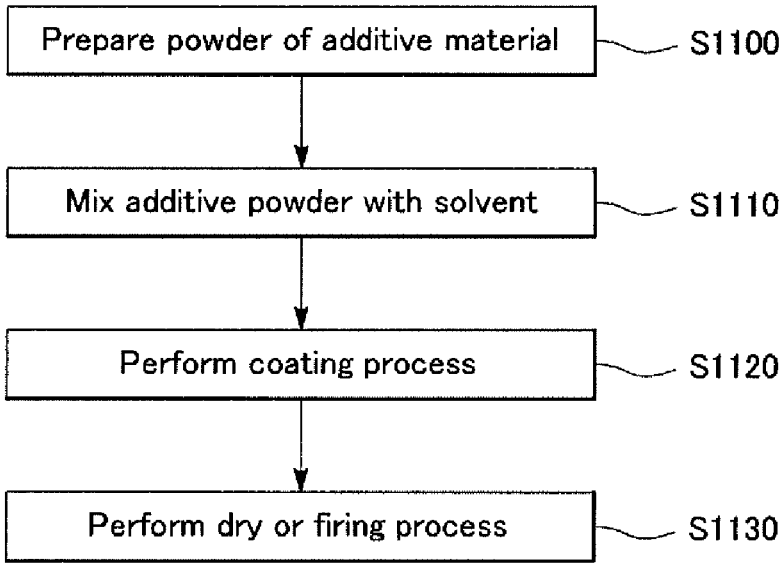
FIG. 19 illustrates a method of manufacturing a phosphor layer including particles of an additive material.
FIGS. 20 and 21 are diagrams for explaining an effect of an additive material.

FIG. 19 illustrates a method of manufacturing a phosphor layer including particles of an additive material.

As shown in FIG. 19, first, a powder of an additive material is prepared in step S1100. For instance, a gas oxidation process is performed on Mg vapor generated by heating Mg to form a powder of MgO.

Next, the prepared additive power is mixed with a solvent in step S1110. For instance, the resulting MgO powder is mixed with methanol to manufacture an additive paste or an additive slurry. A binder may be added so as to adjust a viscosity of the additive paste or the additive slurry.

Subsequently, the additive paste or slurry is coated on the phosphor layer in step S1120. In this case, a viscosity of the additive paste or the additive slurry is adjusted so that the particles of the additive material are smoothly positioned between the particles of the phosphor material.

Subsequently, a dry process or a firing process is performed in step S1130. Hence, the solvent mixed with the additive material is evaporated to form the phosphor layer of FIG. 10.

Figure 21:
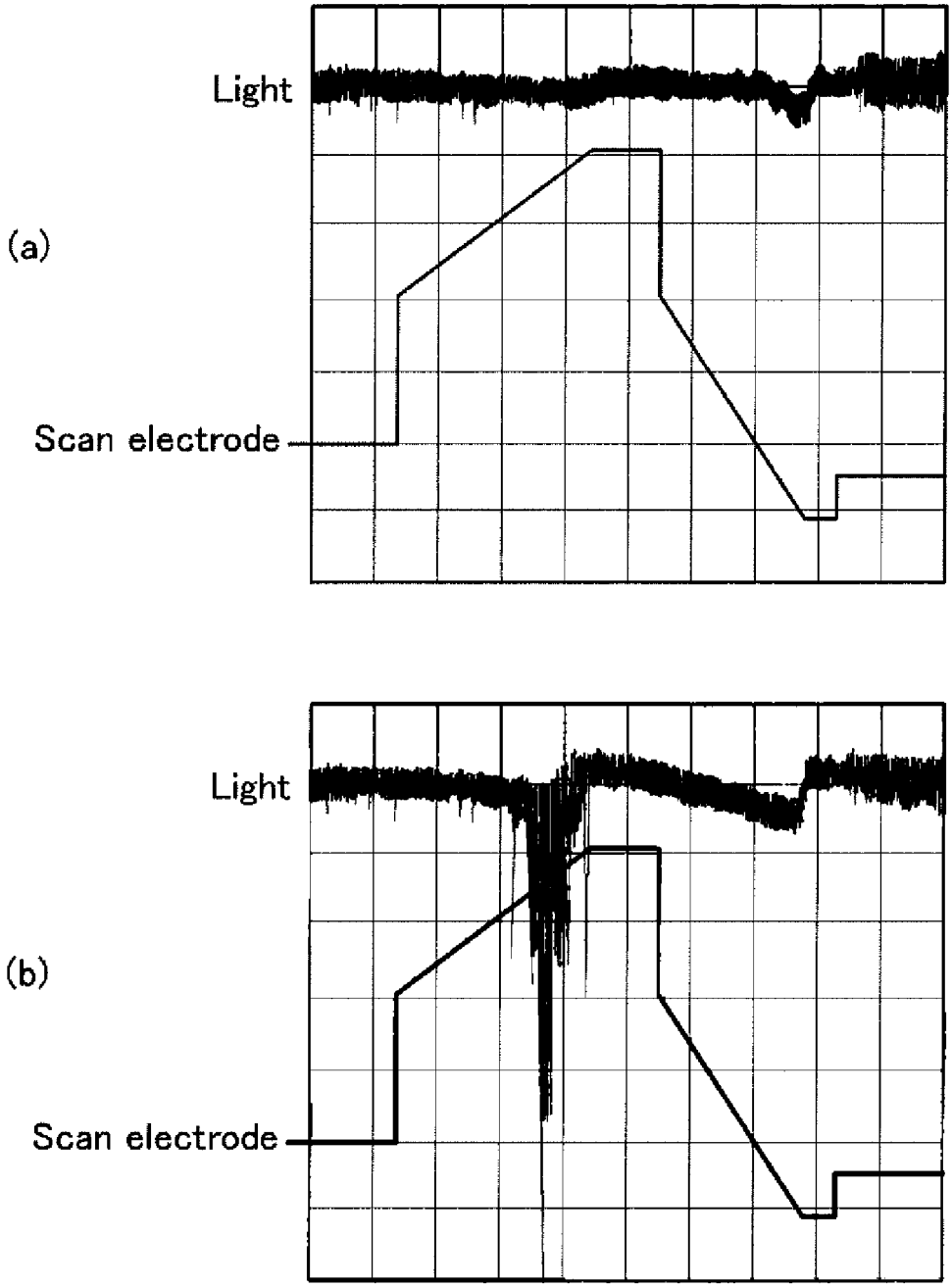

FIGS. 20 and 21 are diagrams for explaining an effect of an additive material.

FIG. 20 is a table showing a firing voltage, a luminance of a displayed image, and a bright room contrast ratio of each of a comparative example and experimental examples 1, 2 and 3. The bright room contrast ratio measures a contrast ratio in a state where an image with a window pattern occupying 45% of the screen size is displayed in a bright room. The firing voltage is a firing voltage measured between the scan electrode and the address electrode.

In the comparative example, the phosphor layer does not include an additive material.

In the experimental example 1, the phosphor layer includes MgO of 3% based on the volume of the phosphor layer as an additive material.

In the experimental example 2, the phosphor layer includes MgO of 9% based on the volume of the phosphor layer as an additive material.

In the experimental example 3, the phosphor layer includes MgO of 12% based on the volume of the phosphor layer as an additive material.

In the comparative example, the firing voltage is 135V, and the luminance is 170 cd/m2.

In the experimental examples 1, 2 and 3, the firing voltage is 127V to 129V lower than the firing voltage of the comparative example, and the luminance is 176 cd/m2 to 178 cd/m2 higher than the luminance of the comparative example. Because the particles of the MgO material as the additive material in the experimental examples 1, 2 and 3 act as a catalyst of a discharge, the firing voltage between the scan electrode and the address electrode is lowered. Furthermore, in the experimental examples 1, 2 and 3, because an intensity of a discharge generated at the same voltage as the comparative example increases due to a fall in the firing voltage, the luminance further increases.

While the bright room contrast ratio of the comparative example is 55:1, the bright room contrast ratio of the experimental examples 1, 2 and 3 is 58:1 to 61:1. As can be seen from FIG. 20, a contrast characteristic of the experimental examples 1, 2 and 3 is more excellent than that of the comparative example.

In the experimental examples 1, 2 and 3, a uniform discharge occurs at a lower firing voltage than that of the comparative example, and thus the quantity of light during a reset period is relatively small in the experimental examples 1, 2 and 3.

In FIG. 21, (a) is a graph showing the quantity of light in the experimental examples 1, 2 and 3, and (b) is a graph showing the quantity of light in the comparative example.

As shown in (b) of FIG. 21, because an instantaneously strong discharge occurs at a relatively high voltage in the comparative example not including the MgO material, the quantity of light may instantaneously increase. Hence, the contrast characteristics may worsen.

As shown in (a) of FIG. 21, because a discharge occurs at a relatively low voltage in the experimental examples 1, 2 and 3 including the MgO material, a weak reset discharge continuously occurs during a reset period. Hence, a small quantity of light is generated, and the contrast characteristics can be improved.

Figure 22:
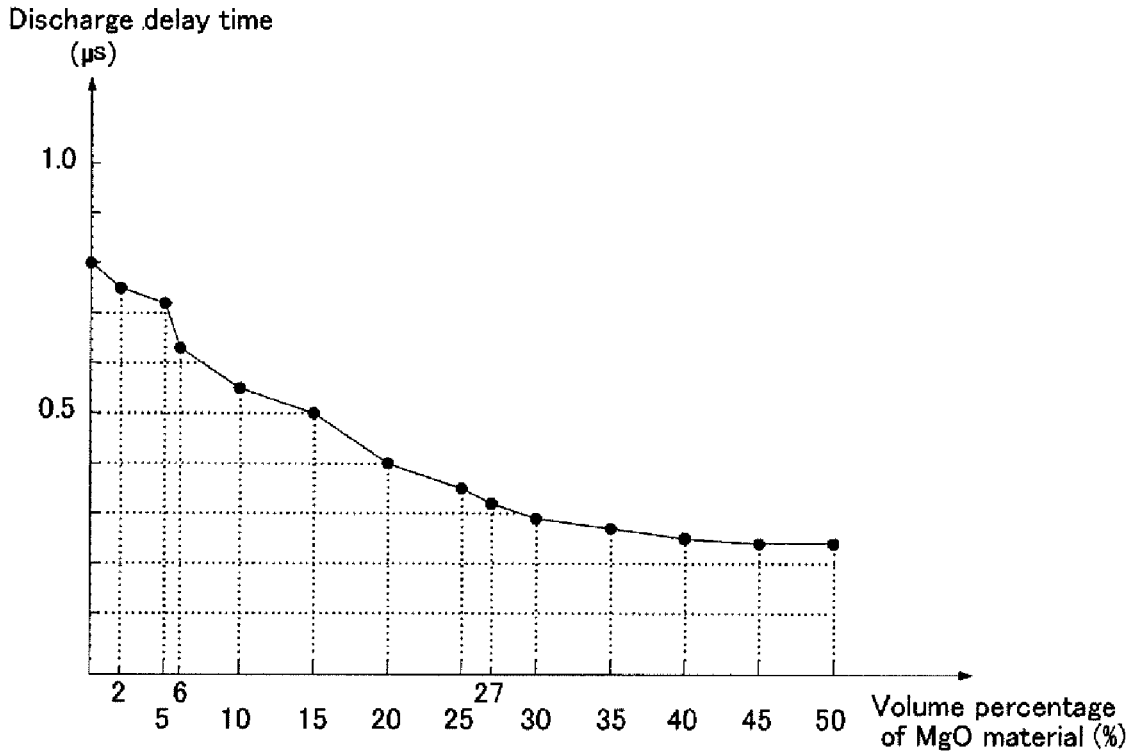
FIG. 22 is a graph showing a relationship between a content of an additive material and a discharge delay time.

FIG. 22 is a graph measuring a discharge delay time of an address discharge while a percentage of a volume of MgO material used as an additive material based on the volume of the phosphor layer changes from 0% to 50%.

The address discharge delay time means a time interval between a time when the scan signal and the data signal are supplied during an address period and a time when an address discharge occurs between the scan electrode and the address electrode.

As shown in FIG. 22, when the volume percentage of the MgO material is 0 (in other words, when the phosphor layer does not include MgO material), the discharge delay time may be approximately 0.8 μs.

When the volume percentage of the MgO material is 2%, the discharge delay time is reduced to be approximately 0.75 μs. In other words, because the particles of the MgO material improve a discharge response characteristic between the scan electrode and the address electrode, an address jitter characteristic can be improved.

Further, when the volume percentage of the MgO material is 5%, the discharge delay time may be approximately 0.72 μs. When the volume percentage of the MgO material is 6%, the discharge delay time may be approximately 0.63 μs.

When the volume percentage of the MgO material lies in a range between 10% and 50%, the discharge delay time may be reduced from approximately 0.55 μs to 0.24 μs.

It can be seen from the graph of FIG. 22 that as a content of the MgO material increases, the discharge delay time can be reduced. Hence, the address jitter characteristic can be improved. However, an improvement width of the address jitter characteristic may gradually decrease. In case that the volume percentage of the MgO material is equal to or more than 40%, a reduction width of the discharge delay time may be small.

On the other hand, in case that the volume percentage of the MgO material is excessively large, the particles of the MgO material may excessively cover the surface of the particles of the phosphor material. Hence, a luminance may be reduced.

Accordingly, the percentage of the volume of the MgO material based on the volume of the phosphor layer may lie substantially in a range between 2% and 40% or between 6% and 27% so as to reduce the discharge delay time and to prevent an excessive reduction in the luminance.

Figure 23:
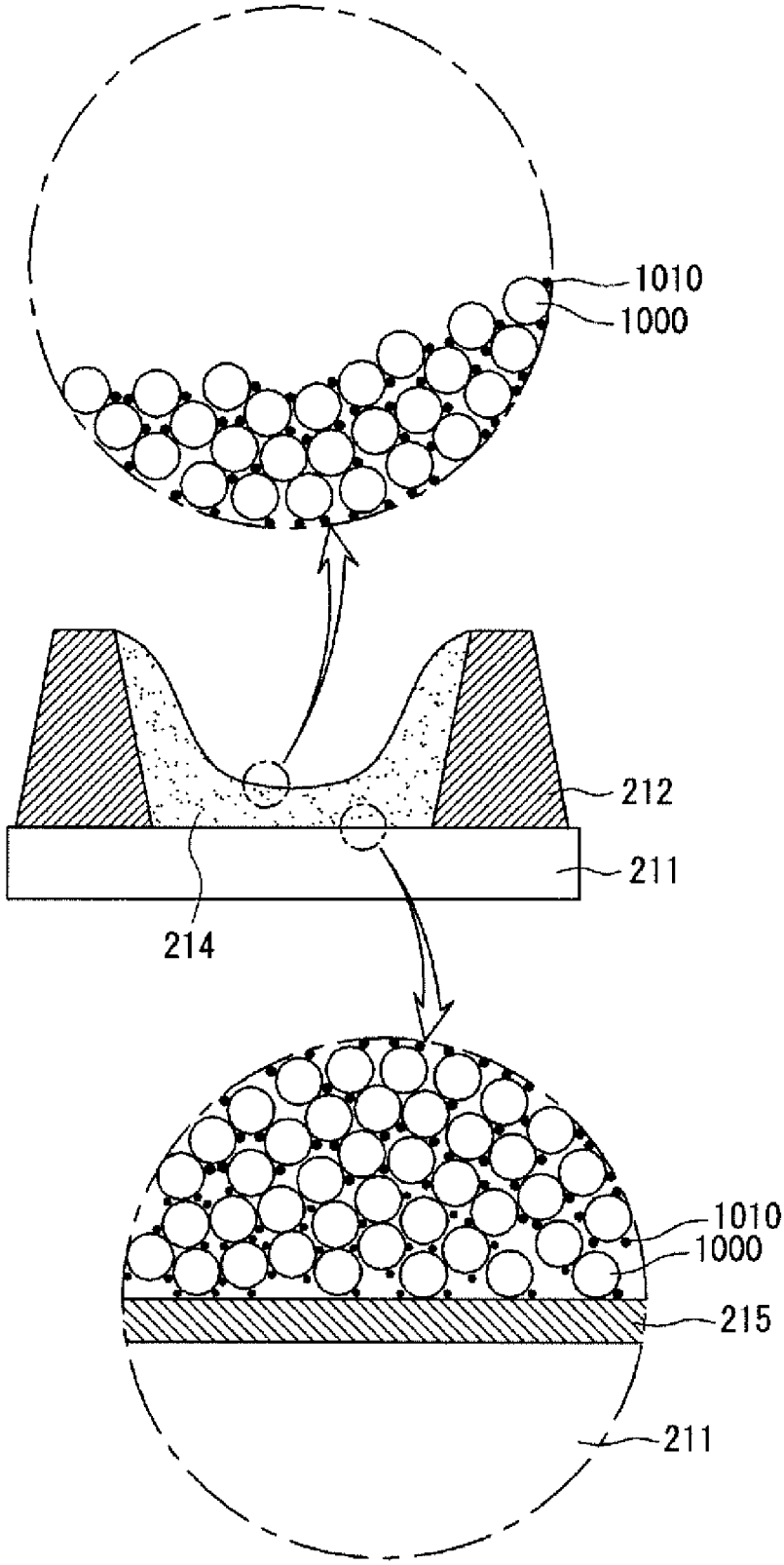
FIG. 23 is a diagram for explaining another structure of a phosphor layer including an additive material.

FIG. 23 shows another structure of a phosphor layer.

As shown in FIG. 23, the particles 1010 of the additive material may be positioned on the surface of the phosphor layer 214, inside the phosphor layer 214, and between the phosphor layer 214 and the lower dielectric layer 215.

When the particles 1010 of the additive material may be positioned on the surface of the phosphor layer 214, inside the phosphor layer 214, and between the phosphor layer 214 and the lower dielectric layer 215, a discharge response characteristic between the scan electrode and the address electrode or between the sustain electrode and the address electrode can be improved.

Figure 24:
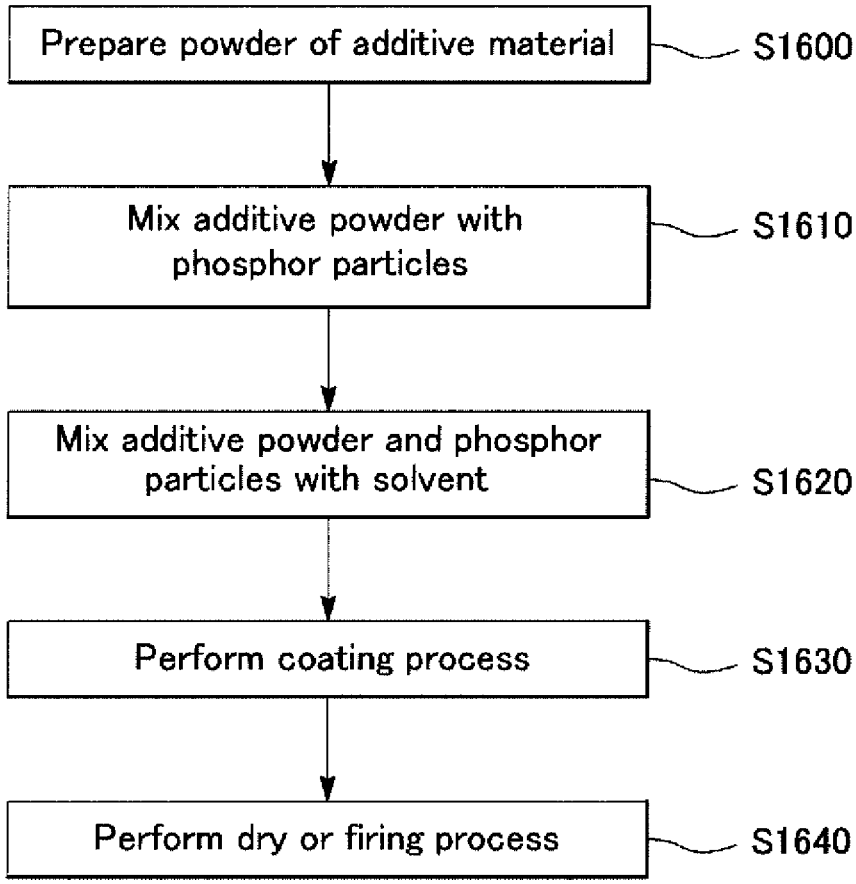
FIG. 24 illustrates another method of manufacturing a phosphor layer including an additive material.

FIG. 24 illustrates another method of manufacturing a phosphor layer.

As shown in FIG. 24, a powder of an additive material is prepared in step S1600. The prepared additive power is mixed with phosphor particles in step S1610. The additive power and the phosphor particles are mixed with a solvent in step S1620. The additive power the phosphor particles mixed with the solvent are coated inside the discharge cells in step S1630. In the coating process, a dispensing method may be used. A dry process or a firing process is performed in step S1640 to evaporate the solvent. Hence, the phosphor layer 214 having the structure shown in FIG. 23 is formed.

Figure 25:
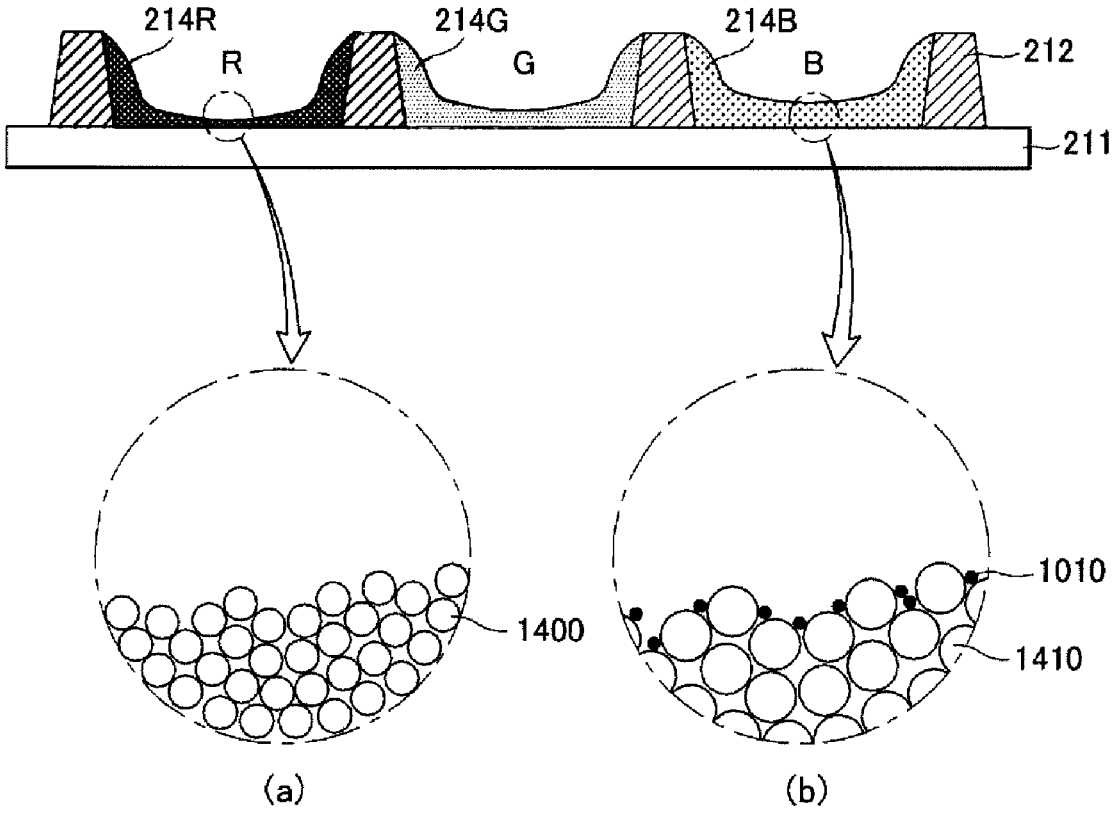
FIG. 25 is a diagram for explaining a method of selectively using an additive material.

FIG. 25 is a diagram for explaining a method of selectively using an additive material.

As shown in FIG. 25, the phosphor layer includes a red phosphor layer 214R emitting red light, a blue phosphor layer 214B emitting blue light, and a green phosphor layer 214G emitting green light. At least one of the red phosphor layer 214R, the blue phosphor layer 214B, or the green phosphor layer 214G may not include the additive material.

For instance, as shown in (a), the red phosphor layer 214R includes particles 1400 of a red phosphor material, but does not include an additive material. As shown in (b), the blue phosphor layer 214B includes particles 1410 of a blue phosphor material and particles 1010 of an additive material.

The structure shown in FIG. 25 may be applied to the case where electrical characteristics of the blue phosphor layer 214B are different from electrical characteristics of the red phosphor layer 214R.

For instance, in case that the amount of wall charges accumulated on the surface of the blue phosphor layer 214B is less than the amount of wall charges accumulated on the surface of the red phosphor layer 214R, a discharge of the blue phosphor layer 214B may occur later than a discharge of the red phosphor layer 214R. However, because the blue phosphor layer 214B includes the particles 1010 of the additive material in the exemplary embodiment, the discharge of the blue phosphor layer 214B may rapidly occur. Hence, the discharge characteristics of the red phosphor layer 214R and the blue phosphor layer 214B can be uniform.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A plasma display apparatus comprising:

a plasma display panel including:

a front substrate on which a scan electrode and a sustain electrode are positioned;

a rear substrate on which an address electrode is positioned to intersect the scan electrode and the sustain electrode;

a lower dielectric layer on the address electrode; and a phosphor layer on the lower dielectric layer, the phosphor layer including a phosphor material and an additive material; and a driver that does not supply a sustain signal to at least one of the scan electrode and the sustain electrode during a sustain period of at least one subfield of a plurality of subfields of a frame.

2. The plasma display apparatus of claim 1, wherein the additive material includes at least one of magnesium oxide (MgO), zinc oxide (ZnO), silicon oxide ($SiO_2$), titanium oxide ($TiO_2$), yttrium oxide ($Y_2O_3$), aluminum oxide ($Al_2O_3$), lanthanum oxide ($La_2O_3$), europium oxide (EuO), cobalt oxide, iron oxide, or CNT (carbon nano tube).

3. The plasma display apparatus of claim 1, wherein at least one of particles of the additive material is positioned on the surface of the phosphor layer.

4. The plasma display apparatus of claim 1, wherein at least one of particles of the additive material is positioned between the phosphor layer and the lower dielectric layer.

5. The plasma display apparatus of claim 1, wherein a percentage of a volume of the additive material based on a volume of the phosphor layer lies substantially in a range between 2% and 40%.

6. The plasma display apparatus of claim 5, wherein a percentage of a volume of the additive material based on a volume of the phosphor layer lies substantially in a range between 6% and 27%.

7. The plasma display apparatus of claim 1, wherein the phosphor layer includes a red phosphor layer, a blue phosphor, and a green phosphor layer, and the additive material is omitted in at least one of the red phosphor layer, the blue phosphor layer, or the green phosphor layer.

8. The plasma display apparatus of claim 1, wherein the driver supplies a first sustain bias signal to the sustain electrode during an address period of the first subfield, and supplies a second sustain bias signal to the sustain electrode during an address period of a second subfield following the first subfield, and a voltage magnitude of the first sustain bias signal is larger than a voltage magnitude of the second sustain bias signal.

9. The plasma display apparatus of claim 1, wherein a voltage difference between the scan electrode and the sustain electrode during an address period of the first subfield is larger than a voltage difference between the scan electrode and the sustain electrode during an address period of a second subfield following the first subfield.

10. The plasma display apparatus of claim 1, wherein after a data signal is applied to the address electrode in the first subfield, the driver supplies both a increasing signal to the scan electrode and a signal with a predetermined positive voltage supplied to the sustain electrode before a rising signal is applied during a reset period of a second subfield following the first subfield.

11. A plasma display apparatus comprising:

a plasma display panel including:

a front substrate on which a scan electrode and a sustain electrode are positioned;

a rear substrate on which an address electrode is positioned to intersect the scan electrode and the sustain electrode;

a lower dielectric layer on the address electrode; and a phosphor layer on the lower dielectric layer, the phosphor layer including a phosphor material and an additive material; and a driver that does not supply a sustain signal to at least one of the scan electrode and the sustain electrode during a sustain period of at least one subfield of a plurality of subfields of a frame, and supplies a plurality of reset signals to the scan electrode during a reset period of a second subfield following the first subfield.

12. The plasma display apparatus of claim 11, wherein the additive material includes at least one of magnesium oxide (MgO), zinc oxide (ZnO), silicon oxide ($SiO_2$), titanium oxide ($TiO_2$), yttrium oxide ($Y_2O_3$), aluminum oxide ($Al_2O_3$), lanthanum oxide ($La_2O_3$), europium oxide (EuO), cobalt oxide, iron oxide, or CNT (carbon nano tube).

13. The plasma display apparatus of claim 11, wherein at least one of particles of the additive material is positioned on the surface of the phosphor layer.

14. The plasma display apparatus of claim 11, wherein at least one of particles of the additive material is positioned between the phosphor layer and the lower dielectric layer.

15. The plasma display apparatus of claim 11, wherein the phosphor layer includes a red phosphor layer, a blue phosphor, and a green phosphor layer, and the additive material is omitted in at least one of the red phosphor layer, the blue phosphor layer, or the green phosphor layer.

16. The plasma display apparatus of claim 11, wherein a highest voltage of a reset signal supplied to the scan electrode during a reset period of the first subfield is larger than highest voltages of the plurality of reset signals supplied to the scan electrode during the reset period of the second subfield.

* * * * *